US008344655B2

(12) United States Patent
Luk et al.

(10) Patent No.: US 8,344,655 B2
(45) Date of Patent: Jan. 1, 2013

(54) POWER AND DATA TRACK LIGHTING SYSTEM

(75) Inventors: John F. Luk, Flushing, NY (US); Dean J. Reiter, Stony Point, NY (US); John T. Ryan, Riverdale, NY (US); Michael J. Tucker, Parsippany, NJ (US); Gary R. Leonard, Wappunger Falls, NY (US)

(73) Assignee: Altman Stage Lighting Co., Inc., Yonkers, NY (US)

( * ) Notice: Subject to any disclaimer, the term of this patent is extended or adjusted under 35 U.S.C. 154(b) by 319 days.

(21) Appl. No.: 12/692,728

(22) Filed: Jan. 25, 2010

(65) Prior Publication Data

US 2011/0181200 A1 Jul. 28, 2011

(51) Int. Cl.
*G05F 1/00* (2006.01)
*H05B 41/14* (2006.01)

(52) U.S. Cl. ..... 315/294; 315/295

(58) Field of Classification Search ..... 315/294, 315/295, 291, 307, 308, 309, 298
See application file for complete search history.

(56) References Cited

U.S. PATENT DOCUMENTS

| | | | | |
|---|---|---|---|---|
| 5,769,527 | A * | 6/1998 | Taylor et al. | 362/85 |
| 6,135,615 | A * | 10/2000 | Lee | 362/648 |
| 7,909,499 | B2 * | 3/2011 | Snagel et al. | 362/648 |
| 2003/0137835 | A1 * | 7/2003 | Mier-Langner et al. | 362/220 |
| 2003/0179578 | A1 * | 9/2003 | Albert et al. | 362/276 |

* cited by examiner

*Primary Examiner* — Minh D A
(74) *Attorney, Agent, or Firm* — Lackenbach Siegel LLP; Myron Greenspan

(57) ABSTRACT

A combined power and data track lighting system includes an elongated track, having a number of longitudinal guide ways for carrying electrically isolated power and data conductors arranged within at least some or the guide ways. An adapter applies power to the power conductors, and another adapter applies control data to the data conductors. An LED luminaire contains LEDs, each of which can generate a discrete color. A data converter converts data on the data lines to control the currents in the individual LEDs to create a desired composite color. Quartz luminaire, Metal-Halide luminaire, Digital Light Processor (DLP) automated computer luminaire, and DMX controlled devices can be supported and controlled through the track, that can be supported on trusses. The main control data is Remote Device Management (RDM) supplied applied to the data conductors.

15 Claims, 18 Drawing Sheets

POWER AND DATA TRACK LIGHTING SYSTEM

BACKGROUND OF THE INVENTION

1. Field of the Invention

This invention relates to power and data track lighting systems and particularly to Remote Device Management (RDM) devices for use in power and data track lighting systems.

2. Description of the Prior Art

The Altman Smart-Track® Lighting System is a revolutionary way to bring digital control signals to addressable architectural luminaires without the need for dimmer packs and bulky cable runs. Whether simple architectural control stations, a laptop, or a DMX-based theatrical lighting console is used, Smart-Track can provide control. The designer can individually control each luminaire hung on the Smart-Track System. This aesthetically pleasing three-circuit DMX track is the perfect solution to any lighting application where appearance and versatility is important.

The Altman Smart-Track is a comprehensive system of components that offers solutions to most lighting challenges. This heavy-duty extruded aluminum track is ideal for demanding applications where a low profile look is desired, but numerous and/or heavy luminaires are needed. The two and three 20-Amp power circuits combined with an innovative data bus offer many design opportunities. Quartz, CDM, and LED luminaires can be run on the same circuit and individually controlled. By including the digital data control signal in the track, the Smart-Track system allows dimming, switching, and effects to be obtained when using Altman's Smart IQ Series of Luminaires. With quartz and CDM luminaires with on-board dimming or control, as well as Altman's Spectra Series LED architectural luminaries for color mixing, the possibilities are endless. Automated luminaires as well as DMX accessories may be controlled all from the Smart-Track system as well using the DMX outlet adapter to break DMX out of the track. Maximum control and reduced energy costs make Altman's Smart-Track lighting system the innovative solution for any application.

Track-lighting systems have been around for many years. Some manufacturers of track lighting include Halo, Juno, Lightolier, and Nordic Aluminium that manufacture lighting tracks and fittings mounted to luminaires for use in their lighting tracks. Lighting tracks are available for use with high AC voltages as well as low DC voltage systems. For safety reasons, and to adhere to the National Electrical Code (NEC) and the UL1574 Standard for Track Lighting Systems, these cannot be mixed together unless they are specifically marked for the different operating voltages. In the alternative, they can be required to have a positive means to prevent the luminaires designed with high-voltage or line-voltage lighting tracks from mixing with luminaires designed for use with low-voltage lighting tracks and vice versa. This NEC safety requirement creates problems for some end users who would like to combine low-voltage and high-voltage track luminaires at the same location, and within close proximity to each other, without presenting any possible safety issues during installation.

Presently, in an installation with track lighting like in a restaurant, art gallery, or restaurant, etc., a single wall dimmer or dimmer pack is connected to one or more circuits in a lighting track. This method of connection allows all line voltage luminaires connected to the lighting track to be dimmed by the same amount if the same wattage lamps are used in the luminaires. This setup is appropriate in a situation where equal light levels are desired. However, when different levels of light are desired, the end-user must use different wattage lamps and be limited by the set lamp wattages available for a particular lampholder, or must run multiple lighting tracks in the same space and dim accordingly. This arrangement sets limitations on the end-user and limits their creative flexibility in lighting design.

At times there arises a need for individual dimming control of separate and discrete line voltage luminaires, without having to run more cables and power lines or lighting tracks to each luminaire.

The IQ architectural series of line voltage and HID luminaires, and particularly the IQ Spectra Series LED color-changing luminaires designed and manufactured by Altman Lighting, Inc., based in Yonkers, N.Y., requires that the LED color-changing track-mounted luminaires be used with conventional track-mounted luminaires utilizing high-voltage incandescent, halogen, compact fluorescent, HID, and UV type lamps, all operating on the same line voltage lighting track. In addition, control data has to be supplied to the new LED color-changing luminaires or other DMX controllable devices used along with the track-mounted luminaires without the need to run additional control cable to the individual track-mounted luminaires. Altman Lighting, Inc. markets this unique arrangement under their Smart-Track System.

The addition of an integral dimmer provided with each line voltage luminaire provides added flexibility and individual control of light levels for each luminaire using a single line-voltage circuit and common data bus. Altman Lighting, Inc. markets this dimming capability as the Smart-Dimmer for use exclusively in their Smart-Track System.

A separate RDM controlled power switch board can be used with HID and CFL luminaires to turn them on or off remotely. An alternate digital or analog dimming control signal may also be provided to dim HID or CFL luminaires for use with electronic dimming ballasts that can utilize the digital or analog dimming control signal. Such new RDM circuit board completes the Altman Smart-Track System and is marketed as the 61-0310 HID dimmer and relay board.

SUMMARY OF THE INVENTION

In the preferred embodiment of the present invention, LEDs in different colors are mounted on a circuit board that is then affixed to a heat sink. The LEDs, circuit board, and heat sink assembly is then installed inside a vented PAR lamp housing. An internal compact power and data adapter and 24 VDC power supply is also installed within the same PAR lamp housing juxtaposed to the LED, circuit board, and heat sink assembly. The data input portion of the compact power and data adapter is sent out via discrete wires and terminates in a DMX track mount fitting or a similar control data connector. The AC power input portion of the 24 VDC power supply is fed by discrete wires leading into a track adapter fitting. The 24 VDC power output from the internal power supply is tied directly to the power input connector of the compact power and data adapter. Likewise, the power and data for the LED circuit board is also tied directly to the power and data output connector of the compact power and data adapter. As an alternate construction to provide better operating temperatures, the compact power and data translator, and 24 VDC power supply may be pulled out of the luminaire body away from the LED, circuit board, and heat sink assembly and mounted externally in an outside housing. In this configuration, no high-voltage AC power enters the main body housing and will be isolated to the outside housing from the track adapter fitting.

An LED color-changing luminaire in accordance with the present invention for use in a DMX track lighting system is a substantial improvement over existing systems, as will be appreciated by those skilled in the art from the following summary and the detailed description of the invention.

It becomes evident that the present invention and system provides various benefits and advantages.

An object of the present invention is to provide a track-mounted LED color-changing luminaire for use on a special track lighting fitting that can be operated from a serial data communications controller.

Another object of the present invention is to provide an LED color-changing luminaire that can be easily manufactured from readily available and off-the-shelf components.

It is a further object of the present invention to provide a family of luminaires centered on the Altman Lighting IQ series luminaires that include the LED color-changing Spectra Series luminaires, halogen lamp luminaires, compact fluorescent, and HID lamp luminaries, including UV black light luminaires. All luminaires in this family can operate simultaneously on the same track lighting system producing different light outputs, color temperatures, and overall looks.

It is yet another object of the present invention to provide luminaires that can all operate on a single type of line voltage track lighting fitting without the need to install low-voltage and line-voltage lighting track.

It is yet a further object of the present invention to integrate the special power and data lighting tracks into a variety of lightweight, yet sturdy aluminum truss assemblies trademarked as the Altman Smart-Truss system.

It is still a further object of the present invention to provide a line voltage luminaire with an integral Smart-Dimmer to allow individual dimming control of separate line voltage luminaires combined to function together with other types of luminaires, including HID, CFL, and low-voltage LED luminaires all on the same power and data Smart-Track or Smart-Truss system.

The Altman IQ series of aesthetic luminaires are designed and manufactured exclusively for architectural applications using primarily the PAR type medium screw base lamps including the PAR20, PAR30, PAR36, PAR38, PAR46, PAR56, and PAR64 sealed PAR type lamps. It should be noted that other lamps and housings could be used as well in this system.

BRIEF DESCRIPTION OF THE DRAWINGS

Those skilled in the art will also appreciate the improvements and advantages that derive from the present invention upon reading the following detailed description, claims, and drawings.

FIG. 7 is a side elevational view of a plurality of luminaires mounted on a track lighting system in accordance with the invention, in which at least one of the luminaires is an LED luminaire, and the others may comprise luminaires such as quartz, HID, fluorescent and the like;

FIG. 13 is a side elevational view of a plurality of luminaires mounted on an integrated truss and track lighting system in accordance with the invention, in which at least one of the luminaires is an LED luminaire and the others may comprise luminaires such as quartz halogen, HID, fluorescent and the like;

FIG. 17 is a side elevational view of a plurality of luminaires mounted on a track lighting system in accordance with the invention, in which at least one of the luminaires is an LED luminaire, another is an incandescent or quartz halogen luminaire with a Smart-Dimmer installed, and the other may comprise luminaires such as HID, or fluorescent and the like;

FIG. 19 is a side elevational view of a plurality of luminaires mounted on an integrated truss and track lighting system in accordance with the invention, in which at least one of the luminaires is an LED luminaire, another is an incandescent or quartz halogen luminaire with a Smart-Dimmer installed, and the other may comprise luminaires such as HID, or fluorescent and the like.

DESCRIPTION OF THE PREFERRED EMBODIMENTS

Figure 1:
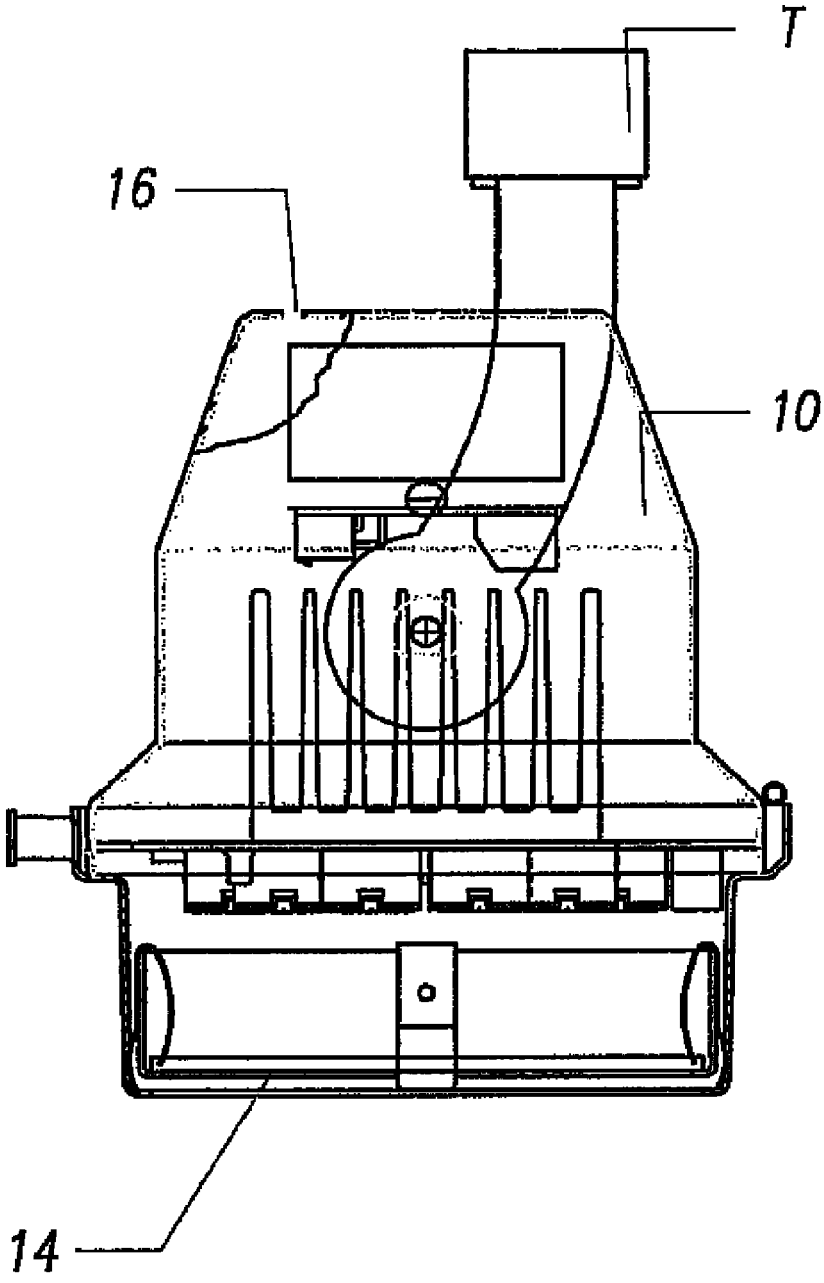
FIG. 1 Side View of an LED luminaire assembly of the type in accordance with the present invention for use with a track.
Figure 2:
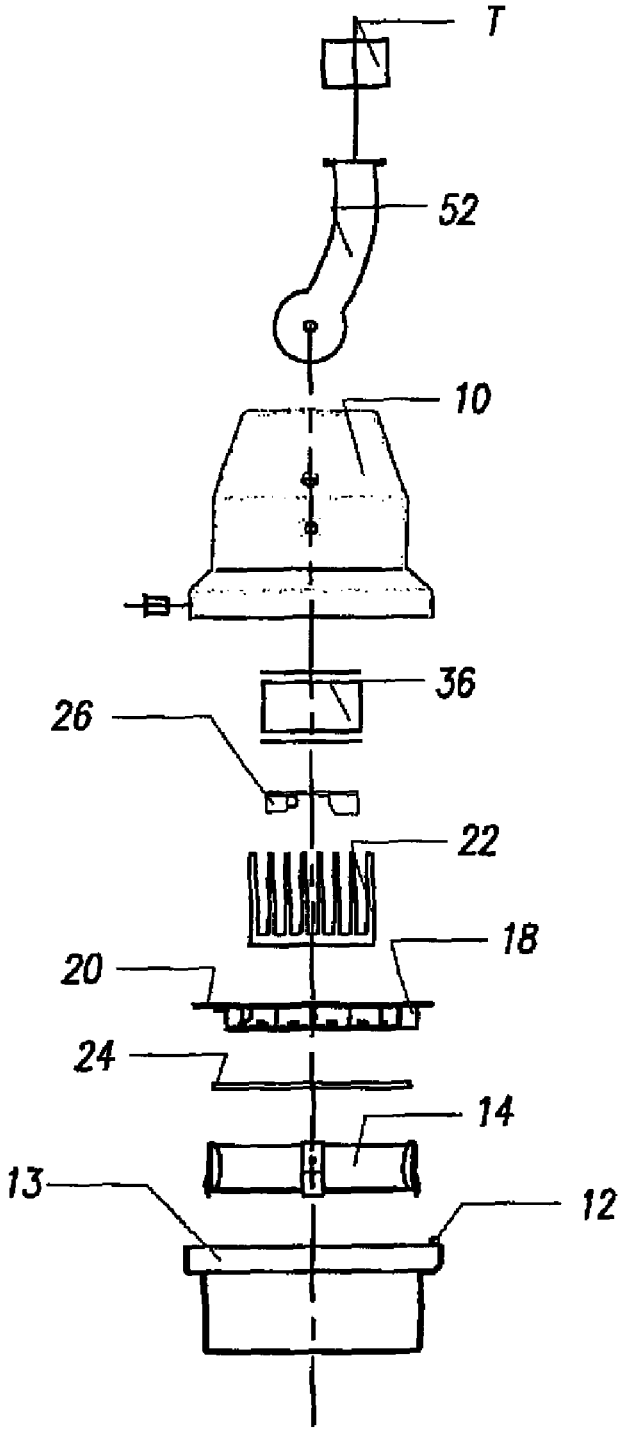
FIG. 2 is an exploded view of the LED luminaire illustrated in FIG. 1.

Referring to the drawings and FIGS. 1 and 2 in particular, and using numbers and letters to refer to identical or similar parts thereof, an IQ series PAR housing 10 is made of spun metal and hinged at 12 to a spun-metal front cover 13 and internal accessory holder 14. The rear of the IQ series PAR housing is provided with slot openings 16 for proper ventilation and cooling of the luminaire. The front accessory holder 14 is designed in such a way as to accept optional accessories including barn doors, snoots, sparkle hoods, baffles, diffusion lenses, etc. The IQ family of luminaires is available with a variety of lamp sources including LED, incandescent, quartz halogen, compact fluorescent (CFL), high intensity discharge (HID), and ultra-violet (UV), the luminaire shown in FIGS. 1, 2, 6 being an RDM LED color changing luminaire including a plurality of LEDs each generating one of a discrete plurality of colors when energized, as discussed below.

One LED circuit board used in the Altman IQ Spectra Series luminaire, and particularly in the IQ38 series, is a complete LED circuit board assembly 18 available from Color Kinetics using the same light source used in their Color Burst 6 (PN: DLE C-101) LED color-changing luminaires. The LED circuit board 18 contains eighteen one-watt Luxeons available from Lumileds Lighting, Inc. with CREE emitters as possible alternate LED light sources. There are six red-, six green-, and six blue-colored Luxeons LEDs. The LED circuit board is rated at 18-watts total and functions with just three inputs. The three inputs are power, ground, and data and are designated as J3, J2, and J1, respectively. The power is 24 VDC, ground is known as COM, and data is a single wire conductor used to address and control the intensities of each colored Luxeon or CREE LED.

For alternate portable applications, the power, ground, and data terminals will be brought out to a XLR type connector or similar data connector. An additional pin can be used to connect the luminaire housing to earth ground, but is not required for UL or NEC for low-voltage applications. For a four-pin XLR type connector, pin 1 will be 24 VDC power using 14 AWG wire, pin 2 will be earth ground using 22 AWG wire, pin 3 will be data using 22 AWG, and pin 4 will be the common ground or COM for the 24 VDC and data line using 14 AWG wire. For a three-pin XLR type connector, pin 1 will be the common ground or COM for the 24 VDC and data line, pin 2 will be the 24 VDC power, and pin 3 will be the data line. The XLR connectors are available from Neutrik USA, Inc., located in Lakewood, N.J., or an equivalent manufacturer, and the four-conductor cable will be the standard Proplex PCCCT cable available from TMB Inc. in Englewood, N.J., or an equivalent cable supplier meeting the same conductor size requirements, ratings, and safety certifications. In certain instances, as with permanent installations, no connector is supplied with the luminaire. Instead, the luminaires are supplied with wire pigtails that are hard-wired directly to the input power and control data source.

The circuit board 18 is a metal clad or thin FR4 substrate to which the eighteen-color Luxeon or CREE LEDs are soldered on one side. The opposite smooth aluminum side 20 of the metal clad or thin FR4 substrate circuit board is then affixed to a heat sink 22 adequately designed to dissipate the heat generated by the eighteen-color Luxeon LEDs. Thermal transfer silicone adhesive type TP190, or Sil-Pads available from Chomerics NA in Woburn, Mass., can be used to affix the circuit board to the heat sink 22. Other methods of attachment will be evident to those skilled in the art. These include mechanical fasteners such as screws, bolts, and clips.

Figure 3:
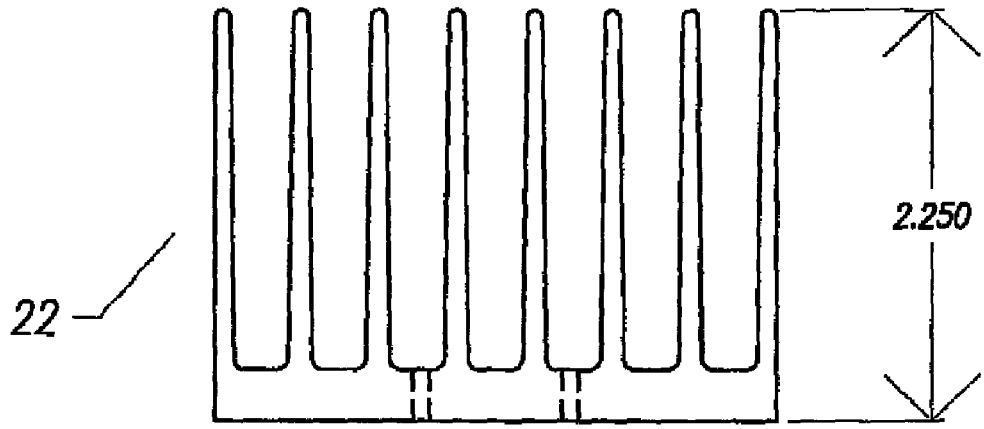
FIG. 3 is a side elevational view of a heat sink that can be used with the LED circuit board illustrated in FIG. 2.
Figure 4:
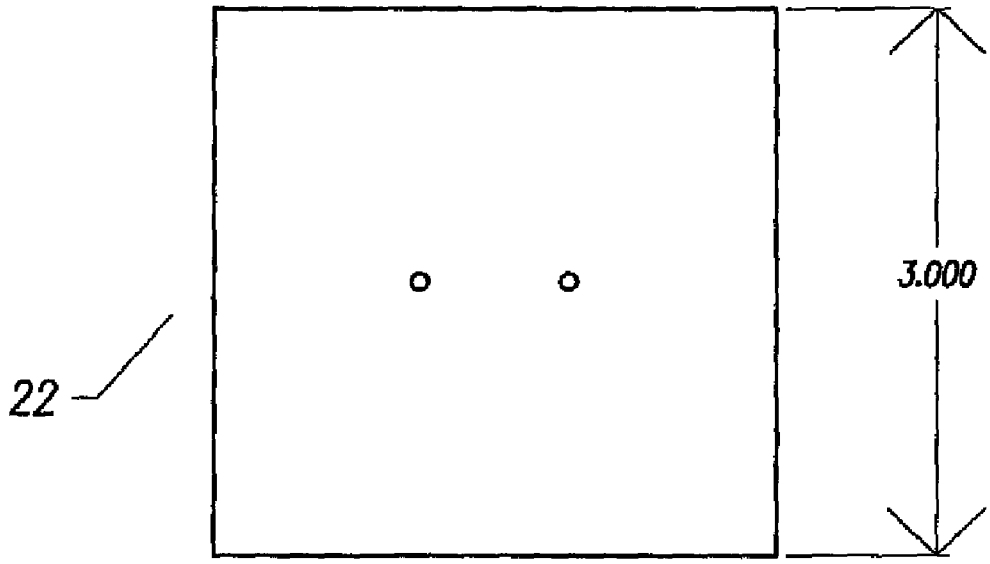
FIG. 4 is a bottom view of the heat sink shown in FIG. 3.

Referring to FIGS. 3 and 4, the heat sink 22 will be one cut from a length of aluminum extrusion. It is available from Aavid Thermalloy Part Number 637303B03000 (VIS #039016). The heat sink is black anodized and has a thermal resistance of 1.8 degrees C. per watt. The height of the heat sink is 2.25 inch, and the outer dimensions are roughly 3.00 inch×3.00 inch square. A thermal rule of thumb for heat sink design is to have the heat dissipation surface area at approximately 6 sq. inch for each LED. Since eighteen Luxeon LEDs are used, at least 108 sq. inch of surface area will be needed for adequate cooling of the eighteen Luxeon LEDs. Calculating the extrusion profile gives us approximately 108 sq. inch of surface area available in this heat sink part. Therefore this heat sink is ideally matched for the LED circuit board used in the IQ38 Spectra Series luminaire. The use of a supplemental cooling fan is optional.

The LED circuit board 18 and heat sink assembly 22 will be mounted into the front portion of the rear PAR38 spun-metal housing 10 and will be held in place by a circular tension spring clip or other securing bracket means (not shown). Although the IQ38 Spectra Series luminaire will have no serviceable parts, the LED circuit board 18 and heat sink assembly 22 can be installed and removed easily from the front portion of the rear PAR38 spun-metal housing 10.

A front 4.75-inch diameter diffusion lens 24, installed in the internal accessory holder, is used to better mix the color beam outputs from each red, green, and blue Luxeon LED. The lens is of ⅛-inch thick plastic lens and has a diffused surface on one side of the flat lens and a smooth surface on the opposite side of the flat lens. It is available from Lee Filters USA in Burbank, Calif., or AIN Plastics PN: P95, and has a transmission rating of 90% or higher.

Figure 5:
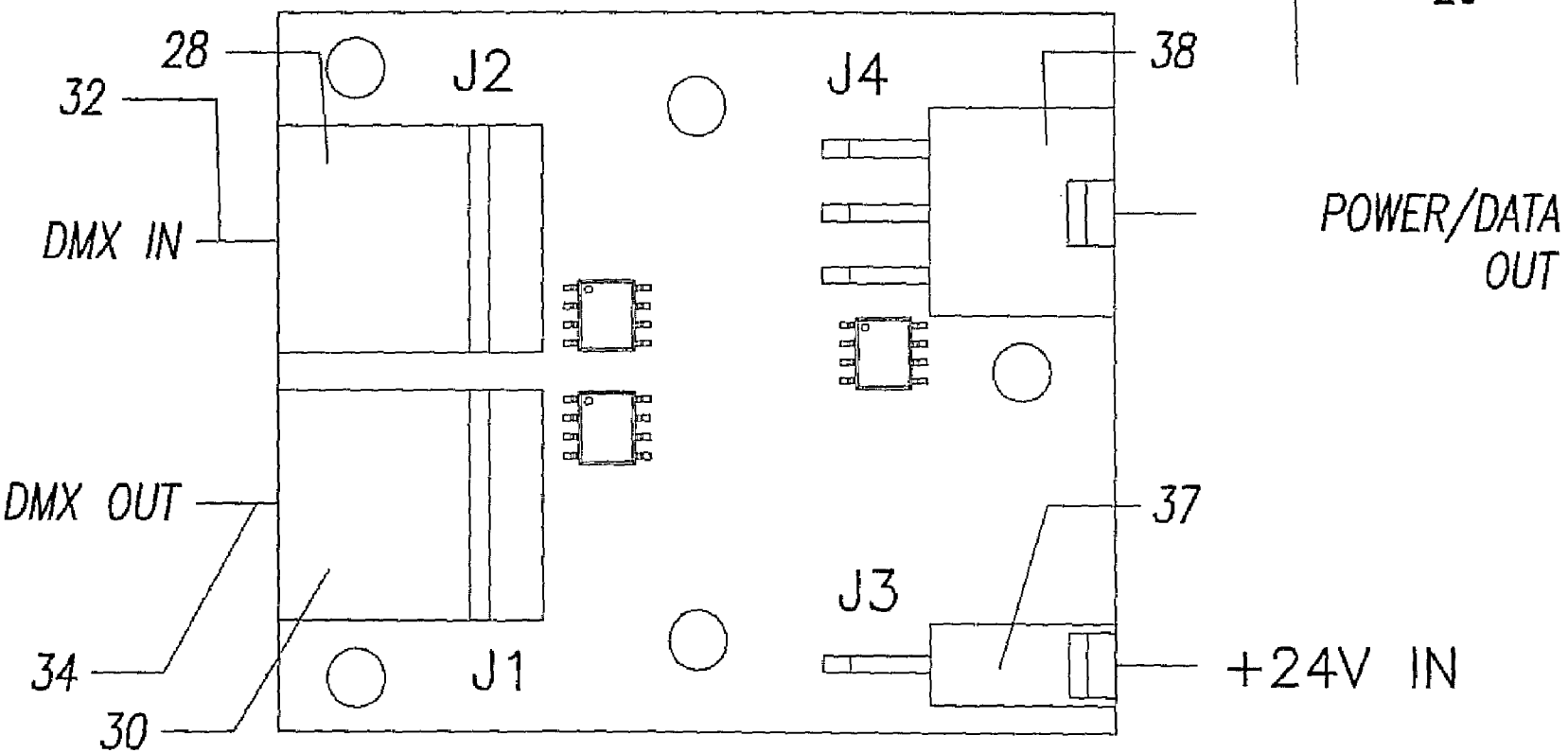
FIG. 5 is a schematic diagram of a compact power and data adaptor (CPDA) printed circuit board for transmitting signals from a multi-conductor track to the LED circuit board shown in FIG. 1 and FIG. 2.

The next electrical component in this intelligent LED color-changing luminaire will be a compact power and data adapter (CPDA) 26, shown schematically in FIG. 5. The adapter includes a board PN: 20-009952 available from James Industries and manufactured exclusively for Color Kinetics of Boston, Mass.

Figure 11:
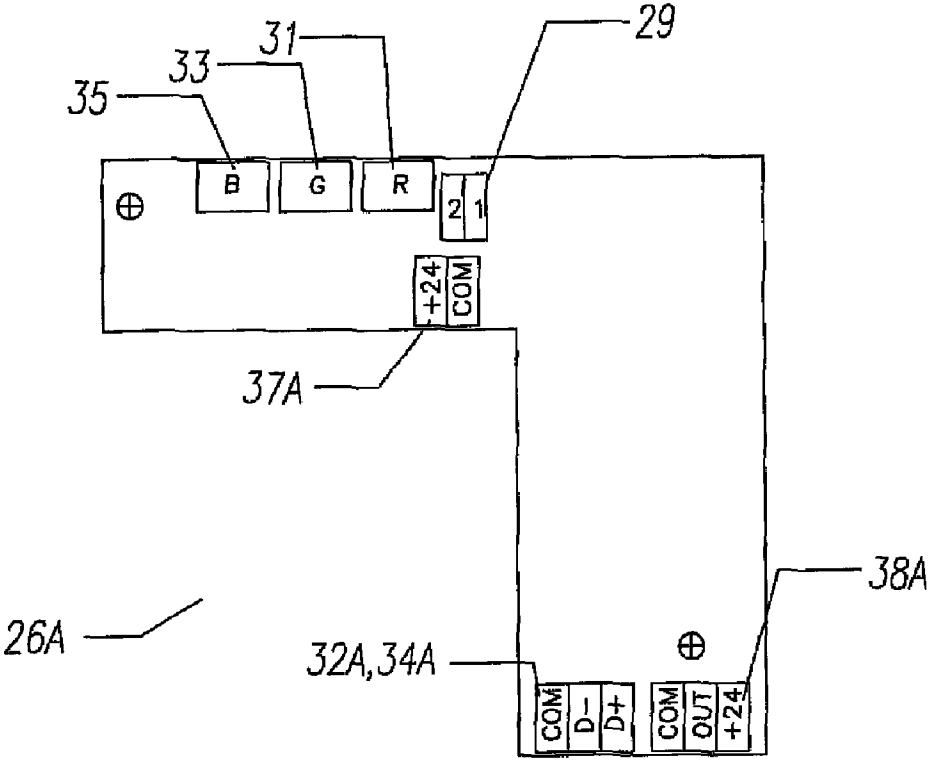
FIG. 11 is a schematic diagram of the new 61-0250 RDM to CK data translator printed circuit board also used for transmitting signals from a multi-conductor track to the LED circuit board shown in FIG. 1 and FIG. 2.

This board is manufactured by FIG. 11 shows an alternate CPDA board 26. Doug Fleenor Design located in Arroyo Grande, Calif. under Altman Lighting part number 61-0250, makes the new CPDA board. The 61-0250 is a RDM to CK data translator circuit board. RDM stands for Remote Device Management. It revolves around the DMX control standard, but allows for bi-directional control and feedback between the RDM controller and RDM compatible device.

The original CPDA board 26 is a double-sided board with approximate dimensions 2.265 inch×1.875 inch. There are two Ethernet type RJ45 connectors 28, 30, designated as J1 and J2, which are the inputs and outputs for a DMX control signal. On the RJ45 connectors, pin 1 is DATA−, pin 2 is DATA+, and pin 3 is GROUND for the DMX control signal. The DMX input control signal going into connectors J1 and J2 are subsequently converted within the CPDA board into a single proprietary data control line designated as pin 6 on connector J4. This proprietary data control signal delivers CHROMACORE to the LEDs to change color intensities.

The latest version of the 61-0250 RDM to CK circuit board 26A is a double-sided L-shaped printed circuit board as shown in FIG. 11. The 61-0250 board will accept both a DMX and an RDM signal. There is a single three-position screw terminal header 32A, 34A marked as D+, D−, and COM serving as the DMX IN 32A and DMX OUT 34A. The RDM input control signal going into 32A or 34A is subsequently converted within the 61-0250 RDM to CK control board into a Color Kinetics DMX output signal located in a separate three-position screw terminal header 38A and marked as +24, OUT, and COM. The LED light engine will later be connected directly to screw terminal header 38A.

Figure 6:
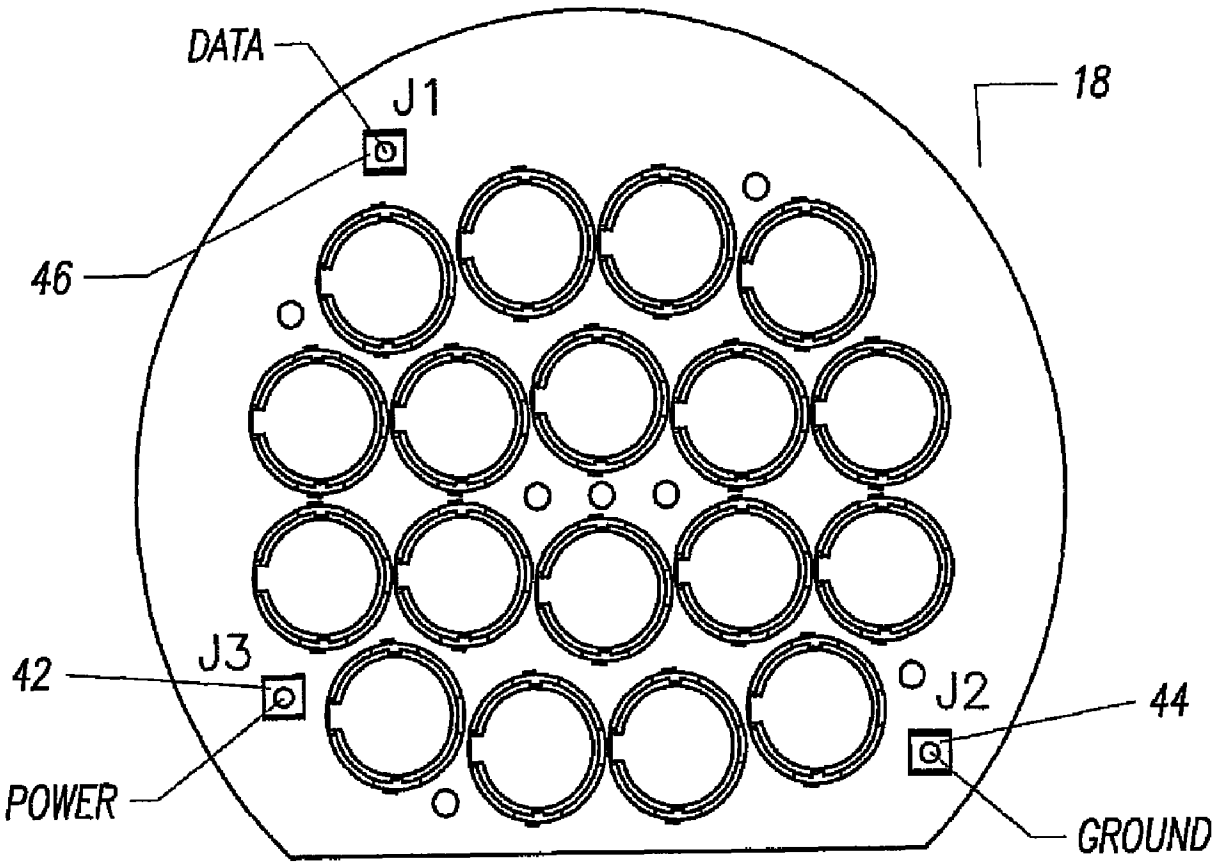
FIG. 6 is a schematic diagram of an LED printed circuit board used in the assembly shown in FIG. 2.

There is a two-position Molex/Waldom Mini-fit Jr. connector designated as J3 for power input into the CPDA board. Pin 1 of J3 is 24 VDC and pin 2 of J3 is ground or COM. A final six-position Molex/Waldom Mini-fit Jr. connector, designated as J4, is used as the power, ground, and data line output to the LED circuit board 18 (FIG. 6). Pin 1 is ground or COM out, pin 2 is 24 VDC power out, and pin 6 is the data line out to the LED circuit board. Pins 3, 4, and 5 of connector J4 have no designated connections and are not used. The RJ45 and Molex/Waldom Mini-Fit Jr. connectors can be replaced with other types of interface connectors, i.e., screw terminal connectors, to ease wiring.

For example, on the 61-0250 RDM to CK control board, there is also provided a two-position screw terminal header 37A marked as +24V and COM to be connected directly to a 24 VDC power supply source. There are additional operating modes included in the new 61-0250 RDM to CK control boards. A binary two-position DIP switch 29 is used to select the mode of control, while three separate decimal rotary switches 31, 33, 35 represent R, G, and B color control respectively.

RDM to CK 61-0250 control description is as follows:

Control:

Selectable 4 different Modes of Control,

Two-position Dipswitch setting for Mode selection.

(May be set with power on or off):

| Dipswitch setting | | Mode |
|---|---|---|
| 00 | OFF-OFF | Manual R, G, B color control. |
| 01 | OFF-ON | Full ON or R, G, B all on to create additive WHITE. |
| 10 | ON-OFF | DMX mode. |
| 11 | ON-ON | RDM mode. |

3 digits, 10-position Rotary (coded) DIP switches set DMX address or Manual color level settings, depending on Mode setting (may be set with power on or off):

| Mode: | |
|---|---|
| Manual Dim | Rotary DIPswitch sets individual R, G, B color intensity. |
| Mode: Full ON | Rotary Dipswitch setting is ignored. |
| Mode: DMX | Rotary DIPswitch sets address (DMX channel 001-512). |
| Mode: RDM | Rotary DIPswitch setting is ignored. |

If address is programmed in RDM mode, then unit switched to another mode (DMX or Manual), and/or disconnected from power, then switched back to RDM mode, the unit should remember and return to its previously programmed RDM address.

Although the CPDA board accepts DMX input control signals and is the preferred control signal in the present invention, other serial data communication protocols can be used in the present invention with conversion hardware to control the intensities of the LEDs. Such serial data communication protocols include, but are not limited to: DMX-512, Ethernet, Strand AMX, RS232, RS485, and DALI (Digital Addressable Lighting Interface), among many others including Remote Device Management (RDM) and Zigbee wireless protocols.

It should be noted that one skilled in the art could substitute other current control techniques and methods to change the intensities of the color LEDs. However, it is obvious that this substitution would result in a product that is similar if not identical to that disclosed in the preferred embodiment of the track-lighting control system of the present invention, even if the specific details of the control techniques and methods were different. In addition, in place of color LEDs used in the IQ38 Spectra Series luminaires, monochrome LEDs including white or a mixed combination of white and amber can be used as the main source of light in the track-mounted LED luminaires of the present invention.

The power supply 36 going into the CPDA board is the Optotronic 24 VDC LED power supply PN: 51512 available from Osram Sylvania. The Optotronic 51512 LED power supply is a UL and CSA recognized electronic component with Class 2 outputs. It is rated at 20-watts with a nominal universal input voltage range of 120-240 volts AC. The Optotronic 51512 LED power supply has an isolated output so it is protected against open circuits, short circuits, overloads, and overheating. It measures approximately 2.36 inch× 2.36 inch×1.20 inch and is protected in a low profile, weather-resistant plastic housing. The normal operating temperature rating for this power supply is from 20 degrees C. up to 50 degrees C., with a maximum temperature rating of 75 degrees C. This power supply is available from Gilway Technical Lamp Company located in Woburn, Mass. Gilway Technical Lamp Company is an exclusive distributor for Osram Sylvania. It should be noted that one skilled in the art could use any +24 VDC LED power supply.

The CPDA board 26 or 61-0250 RDM to CK control board 26A, and the LED power supply 36 mentioned above are all also installed inside the IQ PAR38 housing. Standoffs and base plates may hold the CPDA board and LED power supply securely together deep inside the rear portion area of the IQ PAR38 spun-metal housing 10 close to the ventilation slots 16.

Figure 7:
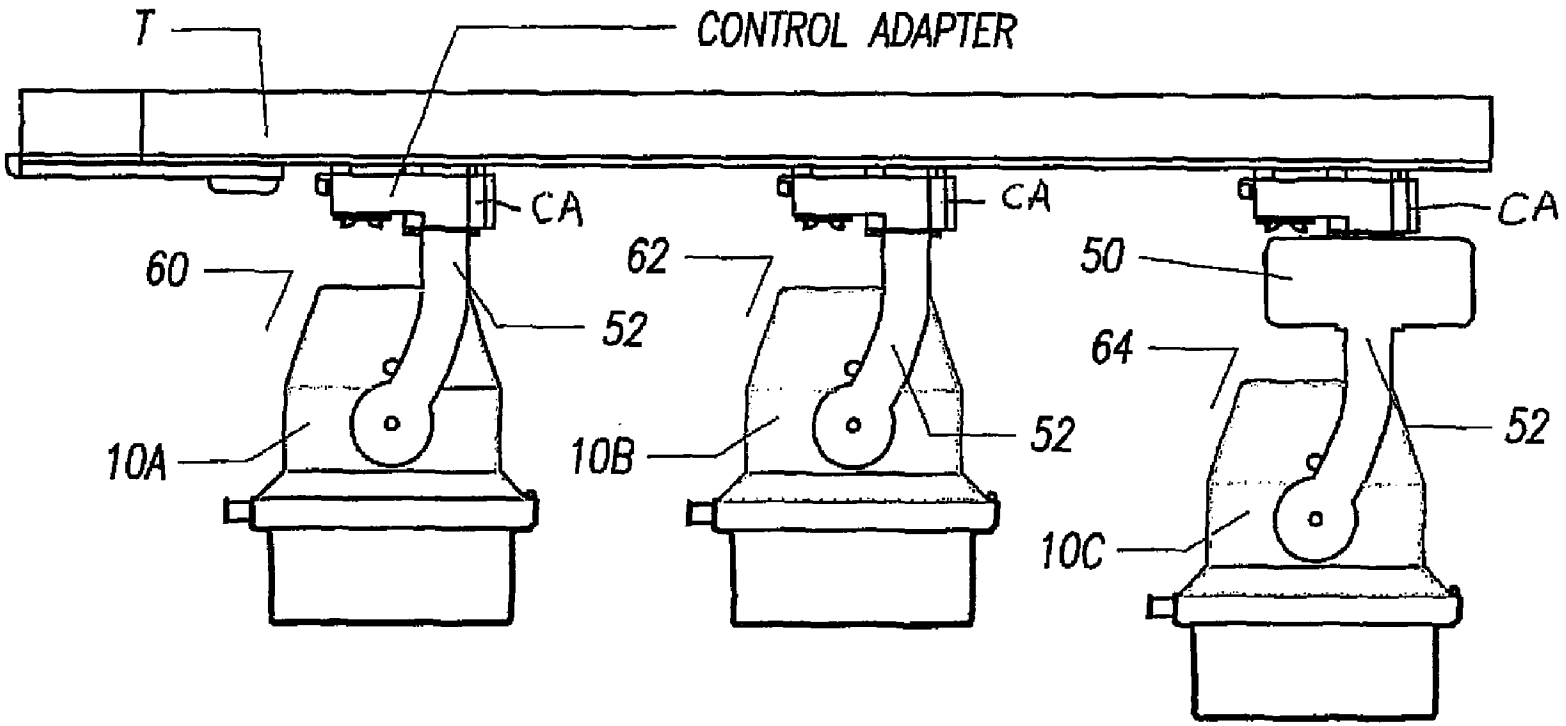

Referring to FIG. 7, for alternate portable luminaire applications, the CPDA board 26 or 61-0250 RDM to CK control board 26A and the LED power supply 36 can be removed from the luminaire housing, such as the housing 10C, and these components are then placed into an auxiliary housing 50. The auxiliary housing 50 may be secured to the yoke 52 or secured in any other known way even to the housing 10C itself. However, because of heat transfer issues, the major and auxiliary housing are connected with a thermal break or barrier to minimize heat transfer there between.

In a further embodiment, the power, ground, and data lines to the LED circuit board are brought in from an external source by way of an extension cable. This LED circuit board extension cable may consist of a six-foot 18/3 SVT type or equivalent cord fitted with a mating Molex/Waldom Mini-Fit Jr. six-position vertical dual connector PN: 39-01-2061 fitted with male terminals PN: 44478-3112. This connector may mate with the female Molex/Waldom Mini-Fit Jr. connector attached to other end of the IQ38 LED circuit board 18 to CPDA cable and attached directly to the LED circuit board 18 by way of input pins J1, J2, and J3. The opposite end of the LED circuit board extension cable is terminated with a Phoenix contact MSTB 2.5/3-ST-5.08 three-position screw terminal plug or XLR type connector. This plug can be used directly with a Color Kinetics Power and Data Supply, i.e., PDS-150e, which allows a user to connect up to six IQ38 luminaires at the same time. The PDS150e provides the 24 VDC, ground, and data necessary to control the intensities of each Luxeon LED located in the LED circuit board 18.

Figure 8:
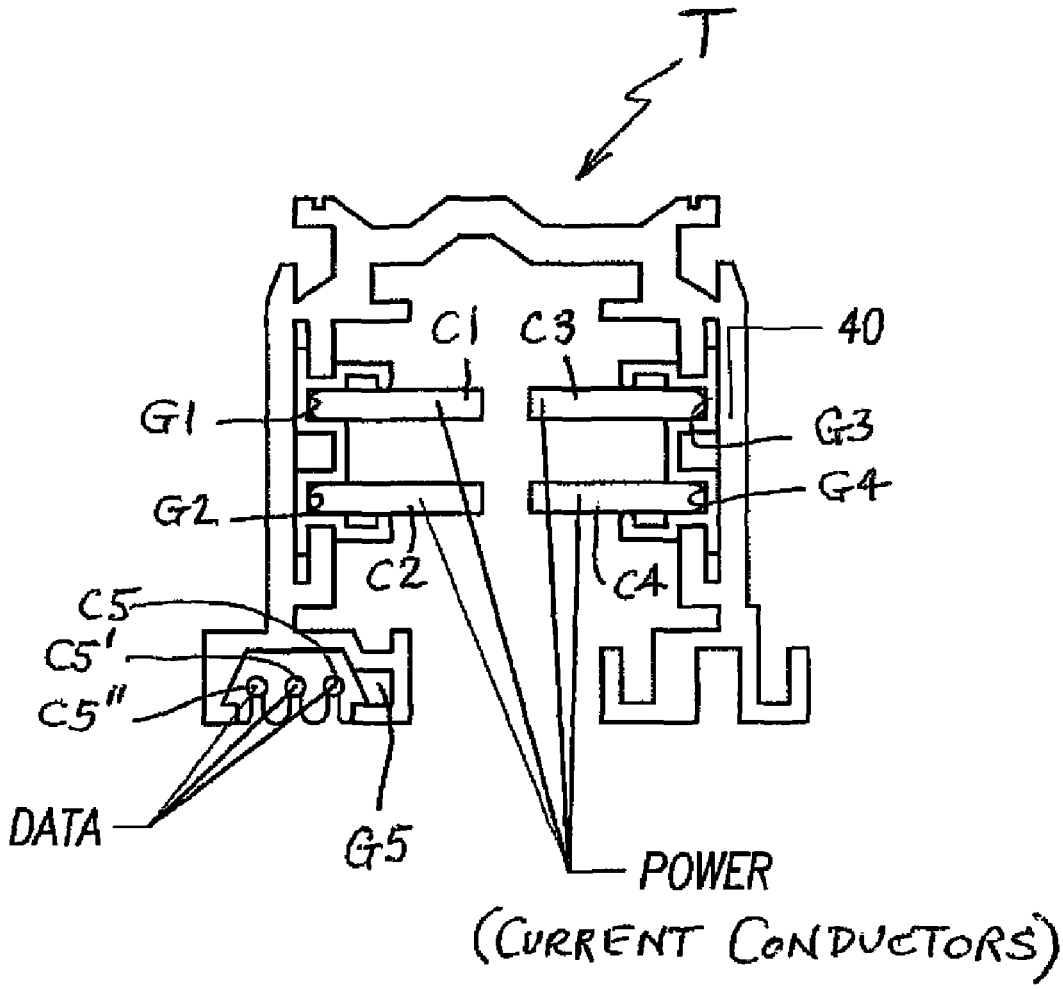
FIG. 8 is a cross-sectional view of a typical track that may be used in connection with the present invention.

In accordance with a feature of the invention, the light luminaires are at least electrically connected to a track T system of the type disclosed in U.S. Pat. No. 5,869,786. In FIG. 8, a cross-section of an extrusion 40 is illustrated. This extrusion is a modification of the extrusion shown in the '786 patent and is designed to work with DMX, RDM, and DALI protocols. The track T includes a plurality of longitudinal guideways G1-G5 (FIG. 8) and adapters CA (FIG. 7) for supporting a plurality of DMX and RDM compatible components (e.g. FIGS. 1, 2, 5, 7, 11). The guideways G1-G5 receive and carry a plurality of current conductors C1-C4 and C5, C5', C5", the conductors C1-C4 being power conductors and conductors C5, C5' and C5" being data conductors. The aforementioned conductors are electrically isolated from each other.

The track-lighting fittings and track adapters used in the preferred embodiment of the present invention are the GLOBAL control SELV-data track system available from Nordic Aluminium represented in North America by Kaltek, Inc., located in Atlanta, Ga. These are illustrated in its lighting luminaire control publication No. 06-2001/2.000, a copy of which is submitted and incorporated herewith. The lighting track fittings include one, two, and three circuit tracks designated by their GC7 series part numbers and their multi-adapter track adapters are available in two and three circuit versions designated by their GC68 series part numbers. A GLOBAL control module designated by part number GCM-DMX is required to bring the DMX control signals from a DMX controller directly to the track-lighting fittings. Nordic Aluminium plans to introduce a modified power and control data track that will take advantage of both DMX and DALI control data protocols.

Nordic Aluminium also released their new GLOBAL-TRAC control FELV-data track system that takes advantage of the DMX, RDM, and DALI control data protocols. The lighting tracks are now GNC part numbers and the "SMART" power and data track adapters are now GAC part numbers. There is now a power only or "DUMB" track adapter with a GA part number that can be used on the new and improved Altman Smart-Track Track Lighting System.

An alternate power and data track lighting system used in the Altman Smart-Track system is provided by Eutrac Corporation marketed as their Eutrac/Dali Intelligent Track. The lighting track fittings include one and two circuit tracks with data bus and their track multi-adaptor fittings are available in single and two circuit versions with data bus. The Eutrac system provides a dedicated neutral bus for each live bus and are rated for 120V at 20 Amps or 230V-240V at 16 Amps.

Internal wiring of the electronic components of the Spectra Series IQ38 luminaires will consist of the following detailed pin-to-pin descriptions. The LED circuit board 18 contains three terminal tabs 42, 44, 46 that accept modular 3/16 inch quick connect spade lugs. The three tabs include power, ground, and data connections. These three terminals designated as J3, J2, and J1 are tied into the CPDA board to connector J4 or to the 3-position terminal block marked as COM, OUT, and +24 on the 61-0250 RDM to CK control board. The mating plug to connector J4 is a Molex/Waldom six-position dual row Mini-fit Jr. connector. Terminal J3 on the LED circuit board connects to pin 2 of connector J4 on the CPDA board for the 24 VDC power; terminal J2 on the LED circuit board connects to pin 1 of connector J4 on the CPDA board for the ground; and terminal J1 on the LED circuit board connects to pin 6 of connector J4 on the CPDA board for the data line.

The actual 24 VDC power and ground to the CPDA board or to the 61-0250 RDM to CK control board may come from the Optotronic 51512 LED power supply. The load side of the Optotronic 51512 LED power supply contains a screw terminal block with designated connections marked as 24 VDC "+" and "−". The "+" terminal will go to pin 1 on connector J3 of the CPDA board or +24 pin of the 2-position terminal block 37A on the 61-0250 RDM to CK control board, and the "−" terminal will go to pin 2 on connector J3 of the CPDA board or to the COM pin of the 2-position terminal block 37A on the 61-0250 RDM to CK control board. Connector J3 is a Molex/Waldom two-position Mini-fit Jr. connector. The line side of the Optotronic 51512 LED power supply also contains a screw terminal block with designated connections marked as L and N. L represents "Live" or the hot lead of the VAC input and N represents the "neutral" or return lead of the VAC input. The input VAC can range from 108 to 254 VAC with nominal input voltages of 120 or 240 VAC. AC power input to the IQ38 Spectra Series luminaire can be provided by a line cord for portable applications, from a track adapter for track lighting applications, or from a ballast for HID and fluorescent lamp applications.

A second LED circuit board used in the Altman IQ Spectra Series luminaire, and particularly in the IQ30 series is a complete LED circuit board assembly available from Color Kinetics using the same light source used in its Color Burst 4 (PN: DLE C-102) LED color changing luminaires. The LED circuit board contains seventy-five 5 mm high brightness LEDs. The LED circuit board is rated at 13.2-watts total and functions with just three inputs. The three inputs are power, data, and ground designated as pins 3, 2, and 1, respectively. The power is 24 VDC, ground is known as COM, and data is a single wire conductor used to address and control the intensities of each colored LED.

For alternate portable luminaire applications, the power, ground, and data terminals can be brought out to a XLR type connector or similar data connector. An additional pin may be used to connect the luminaire housing to earth ground, but is not a requirement by UL or NEC for low-voltage applications. For a four-pin XLR type connector, pin 1 will be 24 VDC power using 14 AWG wire, pin 2 will be earth ground using 22 AWG wire, pin 3 will be data using 22 AWG, and pin 4 will be the common ground or COM for the 24 VDC and data line using 14 AWG wire. For a three-pin XLR type connector, pin 1 will be the common ground or COM for the 24 VDC and data line, pin 2 will be the 24 VDC power, and pin 3 will be the data line. The XLR connectors are available from Neutrik USA, Inc., located in Lakewood, N.J., or an equivalent manufacturer, and the four-conductor cable can be the standard Proplex PCCCT cable available from TMB Inc. in Englewood, N.J., or an equivalent cable supplier meeting the same conductor size requirements, ratings, and safety certifications. In certain instances like permanent installations, no connector is supplied with the luminaire. Instead, the luminaires are supplied with wire pigtails 70 that are hard-wired directly to the input power and control data source, as suggested in FIGS. 9 and 13.

The seventy-five 5 mm high brightness color LEDs are soldered to one side of a circuit board 18. The opposite side of the circuit board is then affixed to the heat sink 22 adequately designed to dissipate the heat generated by the seventy-five 5 mm high brightness color LEDs. Thermal transfer silicone adhesive type TP190 or Sil-Pads available from Chomerics NA in Woburn, Mass., can be used to affix the circuit board to the heat sink.

The heat sink 22 (FIGS. 3, 4) used is typically one cut from a length of aluminum extrusion. It is available from Aavid Thermalloy Part Number 609753B02276 [VIS #060975]. This heat sink is preferably black anodized and has a thermal resistance of 4.43 degrees C. per watt. The height of the heat sink is 0.678 inch, and the outer dimensions are roughly 2.276 inch×2.276 inch. A thermal rule of thumb for heat sink design is to have the heat dissipation surface area at approximately 6 sq. inch for each LED. This heat sink is ideally matched for the LED circuit board used in the IQ30 Spectra Series luminaire. The use of a supplemental cooling fan is optional.

Referring to FIGS. 1 and 2, the LED circuit board 18 and heat sink assembly 22 mounts into the front portion of the rear PAR30 spun-metal housing 10 and is held in place by a circular tension spring clip 12 or other securing bracket means. In the IQ30 Spectra Series luminaire, the LED circuit board and heat sink assembly can be installed and removed easily from the front portion of the rear PAR30 spun metal housing.

A front 3.725 inch diameter diffusion lens 24 installed within the internal accessory holder is used to better mix the color beam outputs from each red, green, and blue LED. It is a ⅛-inch thick plastic lens with a diffused surface on one side of the flat lens and a smooth surface on the opposite side of the flat lens. It is available from Lee Filters USA in Burbank, Calif., or AIN Plastics PN: P95, and has a transmission rating of 90% or better.

The next electrical component in this intelligent LED color changing luminaire is a compact power and data adapter (CPDA) board 26—PN: 20-009952 available from James Industries and manufactured exclusively for Color Kinetics of Boston, Mass.

FIG. 11 shows an alternate manufacturer for the CPDA board 26 and is made by Doug Fleenor Design located in Arroyo Grande, Calif. under Altman Lighting part number 61-0250. The 61-0250 is a RDM to CK data translator circuit board. RDM stands for Remote Device Management. It revolves around the DMX control standard, but allows for bi-directional control and feedback between the RDM controller and RDM compatible device. The original CPDA board is a double-sided board approximately 2.265 inch× 1.875 inch in dimension. There are two Ethernet type RJ45 connectors designated as J1 and J2, which are the inputs and outputs for a DMX control signal. On the RJ45 connectors, pin 1 is DATA−, pin 2 is DATA+, and pin 3 is GROUND for the RDM control signal. The RDM input control signal going into connectors J1 and J2 are subsequently converted within the CPDA board into a single proprietary data control line designated as pin 6 on connector J4. This proprietary data control signal delivers data signals to the LEDs to change color intensities.

The latest version of the 61-0250 RDM to CK circuit board 26A is a double-sided L-shaped printed circuit board. There is a single three-position screw terminal header 32A, 34A marked as D+, D−, and COM serving as the DMX IN 32A and DMX OUT 34A. The 61-0250 board will accept both a DMX and an RDM signal. The RDM input control signal going into 32A or 34A is subsequently converted within the 61-0250 RDM to CK control board into a Color Kinetics DMX output signal located in a separate three-position screw terminal header 38A and marked as +24, OUT, and COM. The LED light engine will later be connected directly to screw terminal header 38A.

There is a two-position Molex/Waldom Mini-fit Jr. connector 37 designated as J3 for power input into the CPDA board. Pin 1 of J3 is 24 VDC and pin two of J3 is ground or COM. A final six-position Molex/Waldom Mini-fit Jr. connector 38 designated as J4 is used as the power, ground, and data line output to the LED circuit board. Pin 1 is ground or COM out, pin 2 is 24 VDC power out, and pin 6 is the data line out to the LED circuit board. Pins 3, 4, and 5 of connector J4 have no designated connections and not used. The RJ45 and Molex/ Waldom Mini-Fit Jr. connectors can be replaced with other types of interface connectors, i.e., screw terminal connectors to ease wiring.

For example, on the 61-0250 RDM to CK control board, there is also provided a two-position screw terminal header 37A marked as +24V and COM to be connected directly to a 24 VDC power supply source. There are additional operating modes included in the new 61-0250 RDM to CK control boards. A binary two-position DIP switch 29 is used to select the mode of control, while three separate decimal rotary switches 31, 33, 35 represent R, G, and B color control respectively.

RDM to CK 61-0250 control description is as follows:
Control:
Selectable 4 different Modes of Control,
Two-position Dipswitch setting for Mode selection.

| Dipswitch setting | | Mode |
|---|---|---|
| 00 | OFF-OFF | Manual R, G, B color control. |
| 01 | OFF-ON | Full on or R, G, B all on to create additive WHITE. |
| 10 | ON-OFF | DMX mode. |
| 11 | ON-ON | RDM mode. |

3 digits, 10-position Rotary (coded) DIP switches set DMX address or Manual color level settings, depending on Mode setting (may be set with power on or off):

| Mode: | |
|---|---|
| Manual Dim | Rotary DIPswitch sets individual R, G, B color intensity. |
| Mode: Full ON | Rotary DIPswitch setting is ignored. |
| Mode: DMX | Rotary DIPswitch sets address (DMX 001-512). |
| Mode: RDM | Rotary DIPswitch setting is ignored. |

If address is programmed in RDM mode, then unit switched to another mode (DMX or Manual), and/or disconnected from power, then switched back to RDM mode, the unit should remember and return to its previously programmed RDM address.

Although the CPDA board and new 61-0250 RDM to CK control board accepts DMX input control signals, and although they are the preferred control signals in the present invention, other serial data communication protocols can be used in the present invention with conversion hardware to control the intensities of the LEDs. Such serial data communication protocols include, but are not limited to DMX-512, Ethernet, Strand AMX, RS232, RS485, DALI (Digital Addressable Lighting Interface) and analog control signal, among many others including RDM (Remote Device Management) and Zigbee wireless protocols.

It should be noted that someone skilled in the arts can substitute other current control techniques and methods to change the intensities of the color LEDs, but it is obvious that the end results arrive at the same if not similar end product disclosed as the preferred embodiment of the present invention and track lighting control system. In addition, in place of color LEDs used in the IQ30 Spectra Series luminaires, monochrome LEDs can be used as the main source of light in the track-mounted LED luminaires of the present invention.

The power supply going into the CPDA board shall be the Optotronic 24 VDC LED power supply PN: 51512 available from Osram Sylvania. The Optotronic 51512 LED power supply is a UL and CSA recognized electronic component with Class 2 outputs. It is rated at 20-watts with a nominal universal input voltage range of 120-240 volts AC. The Optotronic 51512 LED power supply has an isolated output so it is protected against open circuits, short circuits, overloads, and overheating. It measures approximately 2.36 inch× 2.36 inch×1.20 inch, and is protected in a low profile and weather-resistant plastic housing. The normal operating temperature rating for this power supply is from −20 degrees C. up to 50 degrees C., with a maximum temperature rating of 75 degrees C. This power supply is available from Gilway Technical Lamp Company located in Woburn, Mass. Gilway Technical Lamp Company is the exclusive distributor for Osram Sylvania. It should be noted that someone skilled in the art could use any +24 VDC LED power supply.

The CPDA board 26 or 61-0250 RDM to CK control board 26A, and the LED power supply 36 mentioned above are all also installed inside the IQ PAR30 housing. Standoffs and base plates will hold the CPDA board and LED power supply securely together deep inside the rear portion area of the IQ PAR30 spun-metal housing 10 close to the four ventilation slots 16.

For alternate portable luminaire applications, the CPDA board 26 or 61-0250 RDM to CK control board 26A, and the LED power supply 36 is removed from the luminaire housing. The power, ground, and data lines to the LED circuit board are then brought in from an external source by way of an extension cable. This LED circuit board extension cable will consist of a six-foot 18/3 SVT type or equivalent cord fitted with a mating Molex/Waldom Mini-Fit Jr. six-position vertical dual connector PN: 39-01-2061 fitted with male terminals PN: 44478-3112. This connector will mate with the female Molex/Waldom Mini-Fit Jr. connector attached to other end of the flexible flat ribbon cable that is soldered or attached directly to the LED circuit board by way of input pins 1, 2, and 3. The opposite end of the LED circuit board extension cable is terminated with a Phoenix contact MSTB 2.5/3-ST-5.08 three-position screw terminal plug or XLR type connector. This plug can be used directly with a Color Kinetics Power and Data Supply, i.e., PDS-150e, which will allow a customer to connect up to twelve IQ30 luminaires at the same time. The PDS150e provides the 24 VDC, ground, and data necessary to control the intensities of each high-brightness 5 mm color LEDs located in the LED circuit board.

The track-lighting fittings and track adapters used in the preferred embodiment of the present invention are the GLOBAL control SELV-data track system available from Nordic Aluminium represented in North America by Kaltek, Inc., located in Atlanta, Ga. The lighting track fittings include 1, 2, and 3 circuit tracks designated by their GC7 series part numbers and their multi-adapter track adapters are available in two and three circuit versions designated by their GC68 series part numbers. A GLOBAL control module designated by part number GCM-DMX is required to bring the DMX control signals from a DMX controller directly to the track-lighting fittings. Nordic Aluminium will be introducing a modified power and control data track that will take advantage of both DMX and DALI control data protocols.

Nordic Aluminium released their new GLOBAL-TRAC control FELV-data track system that takes advantage of the DMX, RDM, and DALI control data protocols. The lighting tracks are now GNC part numbers and the "SMART" power and data track adapters are now GAC part numbers. There is now a power only or "DUMB" track adapter with a GA part number that can be used on the new and improved Altman Smart-Track Lighting System.

An alternate power and data track lighting system used in the Altman Smart-Track system is provided by Eutrac Corporation marketed as their Eutrac/Dali Intelligent Track. The lighting track fittings include one and two circuit tracks with data bus and their track multi-adaptor fittings are available in single and two circuit versions with data bus. The Eutrac system provides a dedicated neutral bus for each live bus and are rated for 120V at 20 Amps or 230V-240V at 16 Amps.

Internal wiring of the electronic components of the IQ30 Spectra Series luminaires will consist of the following detailed pin-to-pin descriptions. The LED circuit board contains three terminal mounting solder pad holes. The three holes include power, ground, and data connections. These three holes designated as pins 1, 2, and 3 are tied into the CPDA board to connector J4 by way of a flexible flat ribbon cable or with separate and discrete minimum 18 AWG stranded wire or to the 3-position terminal block marked as COM, OUT, and +24 on the 61-0250 RDM to CK control board. The mating plug to connector J4 is a Molex/Waldom six-position dual-row Mini-fit Jr. connector. Pin 3 on the LED circuit board will connect to pin 2 of connector J4 on the CPDA board for the 24 VDC power; pin 1 on the LED circuit board will connect to pin 1 of connector J4 on the CPDA board for the ground; and pin 2 on the LED circuit board will connect to pin 6 of connector J4 on the CPDA board for the data line.

The actual 24 VDC power and ground to the CPDA board or to the 61-0250 RDM to CK control board will come from the Optotronic 51512 LED power supply. The load side of the Optotronic 51512 LED power supply contains a screw terminal block with designated connections marked as 24 VDC "+" and "−". The "+" terminal will go to pin 1 on connector J3 of the CPDA board or +24 pin of the 2-position terminal block 37A on the 61-0250 RDM to CK control board, and the "−" terminal will go to pin 2 on connector J3 of the CPDA board or to the COM pin of the 2-position terminal block 37A on the 61-0250 board. Connector J3 is a Molex/Waldom two-position Mini-fit Jr. connector. The line side of the Optotronic 51512 LED power supply also contains a screw terminal block with designated connections marked as L and N. L represents "Live" or the hot lead of the VAC input and N represents the "Neutral" or return lead of the VAC input. The input VAC can range from 108 to 254 VAC with nominal input voltages of 120 or 240 VAC. AC power input to the IQ30 Spectra Series luminaire can be provided by a line cord for portable applications, from a track adapter for track lighting applications, or from a ballast for HID and fluorescent lamp applications.

The preferred embodiment for this application will be an IQ Spectra Series luminaire mounted to a special RDM track adapter. The three RDM control signals from the Nordic Aluminium GLOBAL Trac Control lighting track fitting will feed into the Global Trac Control multi-adapter GC68 or new GAC100. The GC68 contains three push-in terminals for each of the three corresponding DMX signals, i.e. DATA− to "−" on the GC68, DATA+ to "+" on the GC68, and GROUND to G on the GC68. The GC68 also contains three screw terminals for AC voltage connections from the lighting track, i.e., live to L on the GC68, neutral to N on the GC68, and ground to the center pin designated with the EARTH GROUND symbol on the GC68. The new GAC100 track adapters now incorporate spring-tensioned pins for better contact with the data control portion of the new lighting track. The GAC100 contains three push-in terminals for each of the three corresponding DMX signals, i.e. DATA− to "−" on the GAC100, DATA+ to "+" on the GAC100, and GROUND to G on the GAC100. The GAC100 also contains three insulation displacement terminals for AC voltage connections from the lighting track, i.e., live to L on the GAC100, neutral to N on the GAC100, and ground to the center pin designated with the EARTH GROUND symbol on the GAC100. A special tool is needed to insert the wires to the designated terminals.

Figure 9:
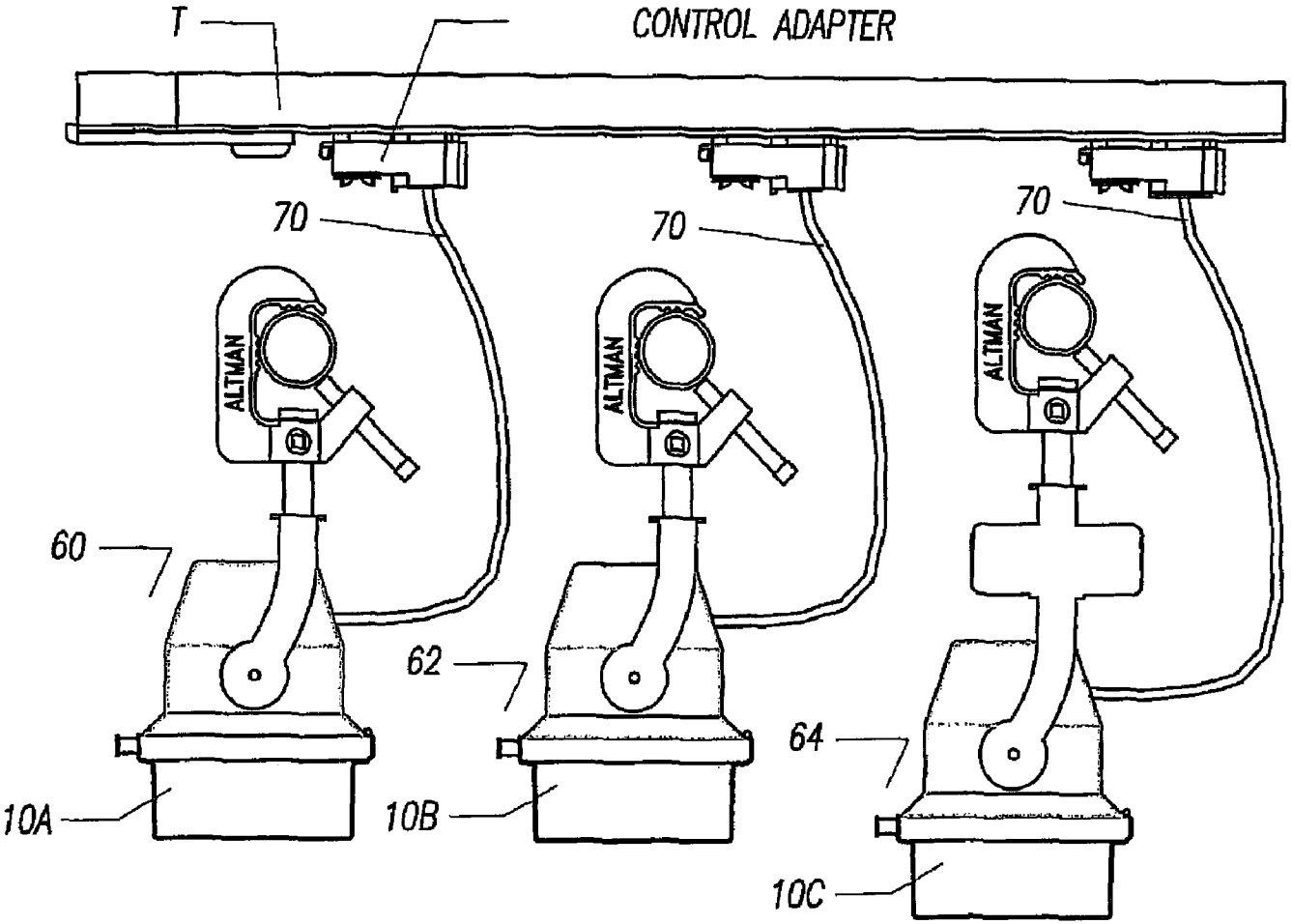
FIG. 9 is similar to FIG. 7, except that the luminaire fixture bodies are physically supported by means of hooks mounted on tubes or pipes and are electrically connected to the track by means of a short length of conductors or pigtails.

As with any electrical connections, wire of an appropriate gauge to handle the current and voltage as required by NEC is to be used at all times. FIGS. 7 and 9 show the complete assembly of an IQ Spectra Series LED color-changing luminaire with all the internal components installed and located.

GLOBAL Control is used as a part of data-controlled lighting to carry the control signal. The GLOBAL Control system allows control of individual light fittings or groups of fittings. This kind of lighting is particularly suitable for special exhibitions—in museums, for example—where varying kinds of ambience are created with lighting. The GLOBAL Control data track is based on the GLOBAL Pro system. Three control wires have been added to the three-circuit track. The control wires transfer the data signal from a control console or other controller to the fitting. The conductors in the GC68 or GAC100 track adapters transmit the signal from the track to the luminaire. The fitting requires an integrated converter card to enable it to receive the signal from a controller. The converter card reads and recognizes the signal leading to the desired function.

Nordic Aluminium owns UK Patent Application No. GB2310326A, "A track conductor assembly with control signal bus," which relates to their GLOBAL Control power and data system.

For tradeshows and industrial applications, the use of the Altman Smart-Track System will help in the connection of DMX and RDM compatible products in a neat and orderly fashion with ease of installation. Altman has taken the next step in providing ease of installation by integrating the Smart-Track power and data system into any aluminum truss section. Altman markets this product as their new Smart-Truss system. Now luminaires or other accessories can be attached directly to the truss portions for added weight support while the power and data can be tapped off directly from the Altman Smart-Track Lighting System.

Presently, Milos Structural Systems located in the Czech Republic offers a M290 electro system for use with their QuickTruss system where they provide AC power only. The Milos M290 electro system is used for exhibition, retail, and display applications. Their M290 QuickTruss is fitted with a Nordic 3-circuit mains track 3×16-amperes and can be produced in any length upon request. The M290 system will work for a wide range of manufacturer's fittings including Erco, Iguzzini, Nokia, and Hoffmeister.

Altman has made an improvement to the Milos M290 electro system and any aluminum truss system by providing both power and data capability, all in a low profile and compact package. The biggest advantage of providing both power and data on a truss system will greatly help the installation and setup. With the integration of power and data into the main structural tubes of different truss configurations, the end-user can now have up to 3×16 A×2 for a single ladder truss; up to 3×16 A×3 for a triple "triangle truss"; and up to 3×16 A×4 for a quad "box" truss.

Figure 12:
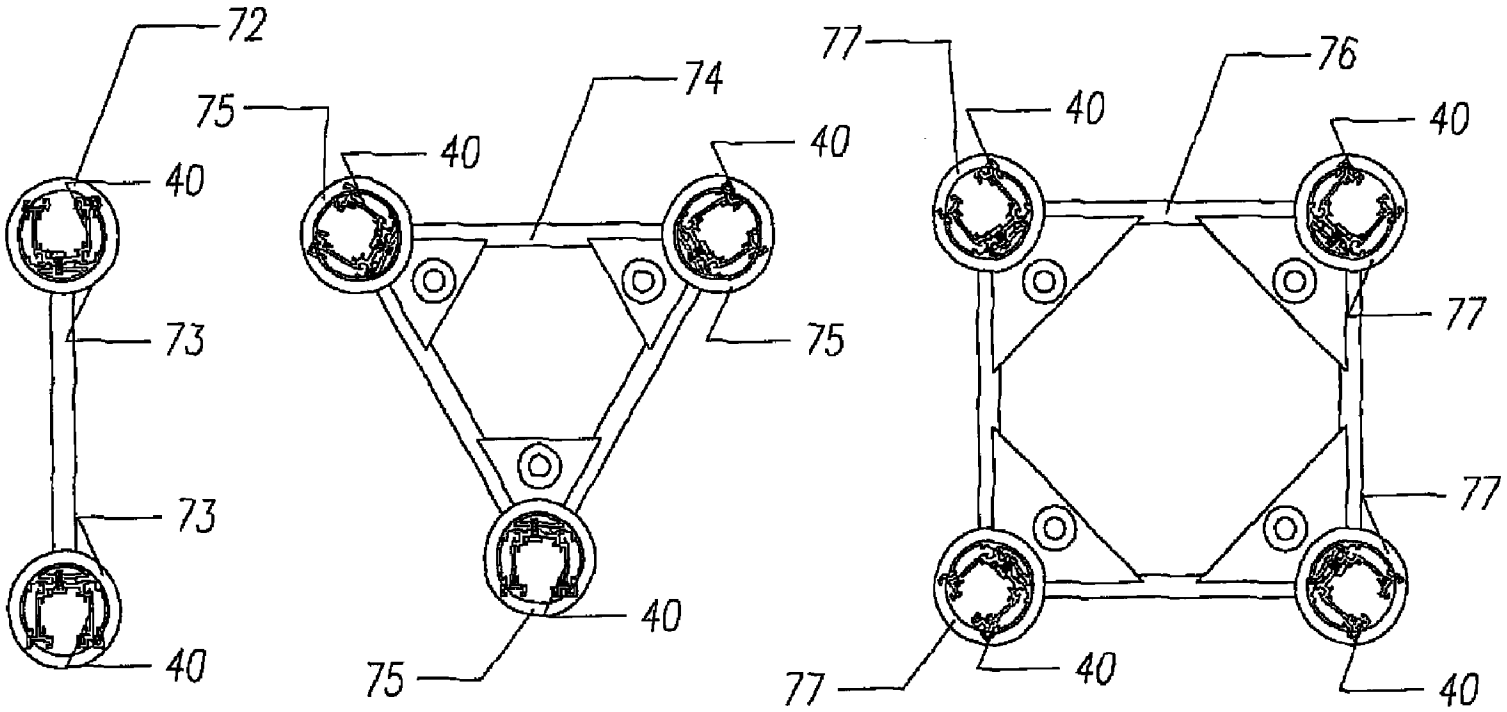
FIG. 12 are front cross-sectional views of integrated truss and track lighting system in various configurations.

FIG. 12 shows a front cross-sectional view of the integrated truss and track lighting system in various configurations. Shown are a dual ladder truss 72, a triple triangle truss 74, and a quad box truss 76. Within the main tube structures 73, 75, and 77 for trusses 74, 76, and 78 respectively, are fitted power and data lighting tracks 40. It will be obvious by someone skilled in the arts to use at least one lighting track 40 within any of the main tube structures 73, 75, or 77 in trusses 74, 76, and 78 respectively.

Figure 13:
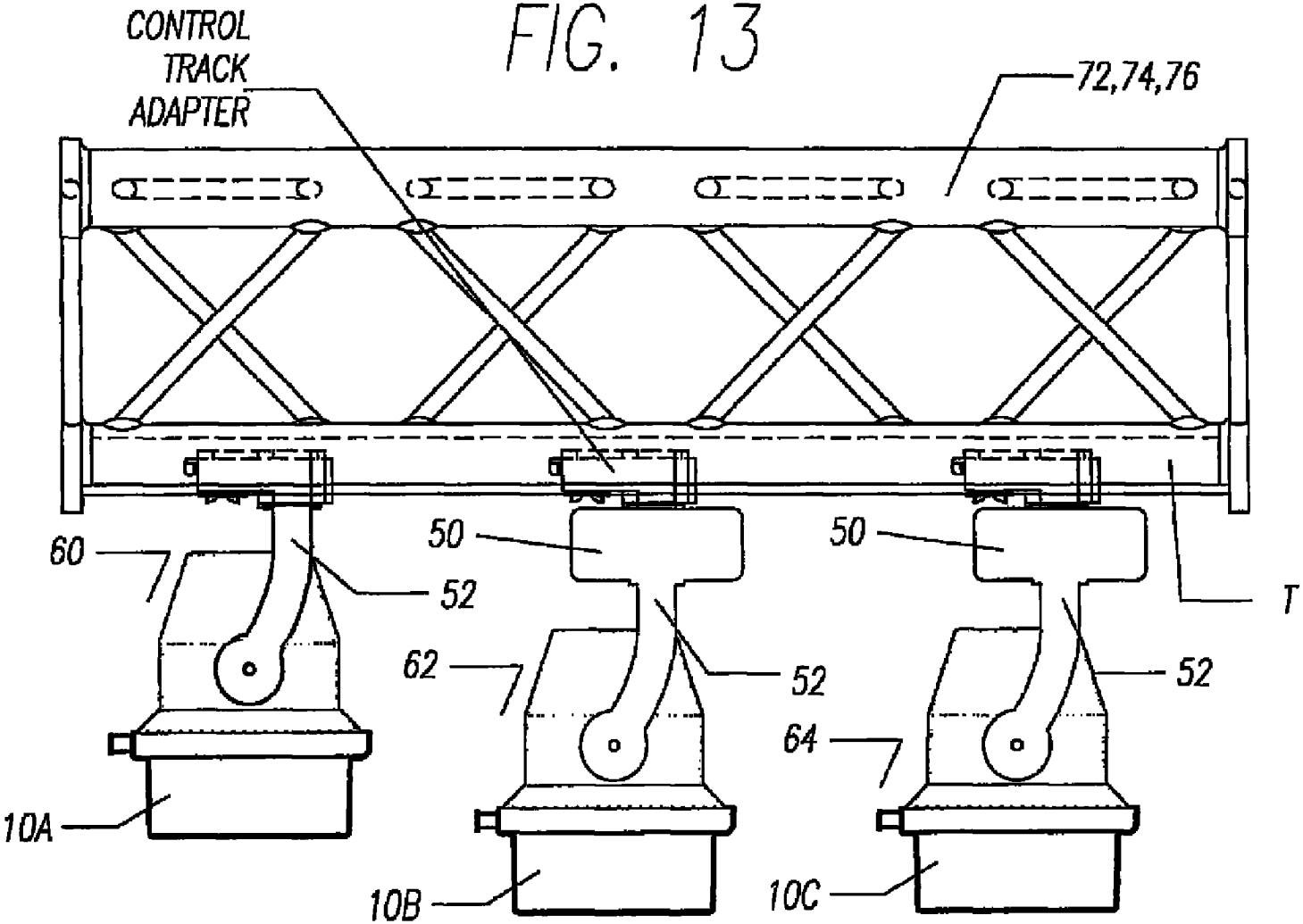

FIG. 13 shows a side elevational view of a plurality of luminaires mounted on an integrated truss and track lighting system in accordance with the invention, in which at least one of the luminaires is an LED luminaire 64 and the others may comprise luminaires such as quartz, HID, compact fluorescent lamp (CFL), and the like. For LED luminaire 64, the CPDA board 26 or 61-0250 RDM to CK control board 26A, and the LED power supply 36 are removed from the luminaire housing, such as the housing 10C, and are then placed into an auxiliary housing 50. The auxiliary housing 50 may be secured to the yoke 52 or secured in any other known way to the housing 10C. Likewise for HID or CFL luminaire 62, the ballast is also located in auxiliary housing 50. The auxiliary housing 50 is secured to yoke 52 or secured in any other known way to housing 10B. Luminaire 60 is a standard quartz or incandescent lamp luminaire devoid of an auxiliary housing 50.

Figure 14:
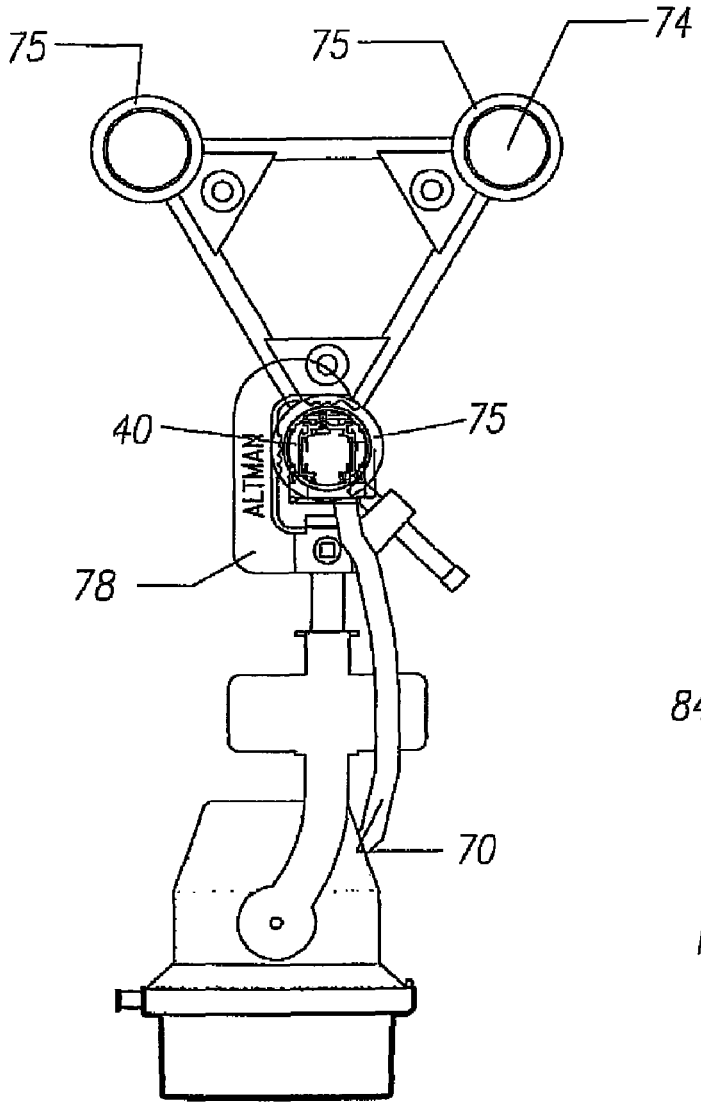
FIG. 14 is a front cross-sectional view of a luminaire body physically supported by means of a hook or clamp mounted onto a truss section and is electrically connected to the track by means of a short length of conductor or pigtail.

FIG. 14 is a front cross-sectional view of the luminaire body physically supported by means of a hook or clamp mounted onto a truss section and is electrically connected to the track by means of a short length of conductor or pigtail. HID or CFL luminaire 62 or LED luminaire 64 is shown attached to support clamp 78. Support clamp 78 is then mounted onto main tube structure 75 of triangle truss 74.

Now similar to FIG. 9, power and data to luminaire 62 or 64 shown in FIG. 14 is supplied by pigtail 70 attached to control track adapter installed into lighting track 40 fitted into main tube structure 75 of triangle truss 74. For more power, other lighting tracks 40 can be installed in the other two main tube structures 75 of truss 74, up to the maximum power allowed by three lighting tracks on a 3-circuit power input connection.

Figure 15:
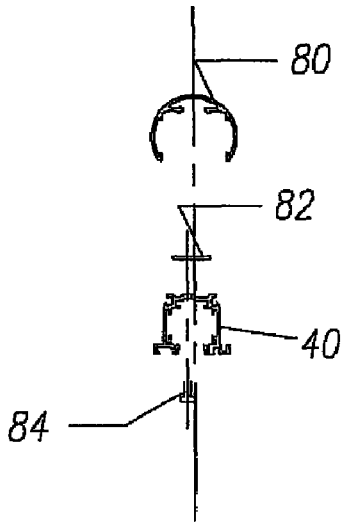
FIG. 15 is an exploded assembly view of the Smart-Truss extrusion, power and data lighting track, mounting bolt, and bar nut profiles used in the arrangement shown in FIG. 14.

FIG. 15 is an exploded assembly view of the Smart-Truss extrusion 80, power and data lighting track 40, mounting bolt 84, and bar nut 82 profiles. Smart-Truss extrusion 80 is mounted inside the main tube structures 75 of truss 74 by welding or other secure mounting means. Mounting bolt 84 is passed through a clearance hole (not shown) located in power and data lighting track 40 and then to bar nut 82. Power and data lighting track 40 is inserted into Smart-Truss extrusion 80 and held together inside Smart-Truss extrusion 80 by means of mounting bolt 84 screwed down to bar nut 82. It will be noted that bar nut 82 is designed to fall into the slot opening provided by Smart-Truss extrusion 80 and will rotate and lock into position as mounting bolt 84 is screwed down securely mounting power and data lighting track 40 onto Smart-Truss extrusion 80. Multiple locations for mounting bolt 84 and bar nut 82 run down the entire length of power and data lighting track 40 for a more secured hold to Smart-Truss extrusion 80.

Figure 16:
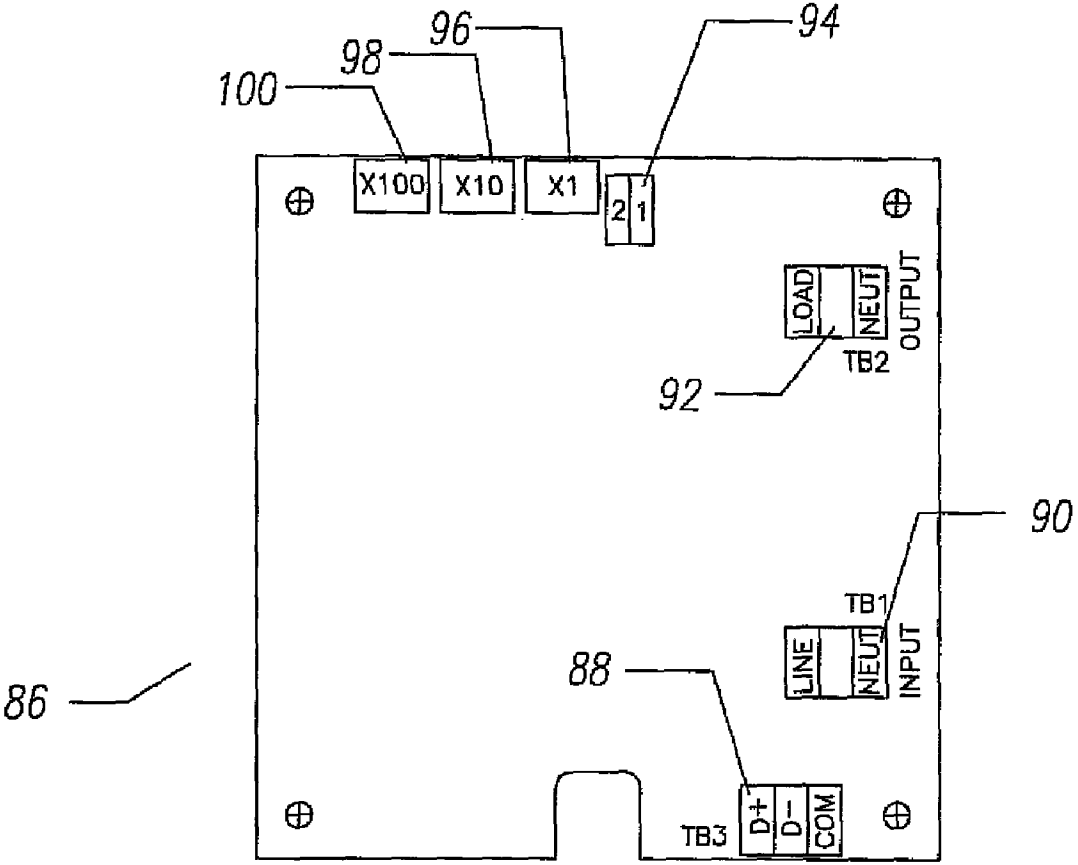
FIG. 16 is a schematic diagram of a new 61-0280 RDM Dimmer printed circuit board used also for transmitting signals from a multi-conductor track to a line voltage luminaire.

FIG. 16 is a schematic diagram of the new 61-0280 RDM Smart-Dimmer printed circuit board used also for transmitting signals from a multi-conductor track to a line voltage luminaire. The 61-0280 RDM Smart-Dimmer board is an SCR-based dimmer that can handle up to 600-watts. RDM stands for Remote Device Management. It revolves around the DMX control standard, but allows for bi-directional control and feedback between the RDM controller and RDM compatible device. It is UL listed for use in a variety of Altman UL listed luminaires and can be used on the Altman Smart-Track System, or as a standalone in portable or surface mount configurations. The board measures approximately 4.0"×4.0" and was designed by Doug Fleenor Designs, Inc. located in Arroyo Grande, Calif.

The latest version of the 61-0280 RDM Smart-Dimmer board 86 is a double-sided printed circuit board with four mounting hole locations and a notch cutout for cable passage. There is a single three-position screw terminal block TB3 88 marked as D+, D–, and COM serving as the RDM IN and RDM OUT to the board. The RDM input control signal going into 88 is subsequently converted within the 61-0280 RDM Smart-Dimmer board and sends a dimmed high voltage output to a separate three-position screw terminal block TB2 92, locally marked as LOAD and NEUT. The incandescent or quartz halogen filament lamp will later be connected directly to screw terminal block TB2 92.

On the 61-0280 RDM Smart-Dimmer board, there is also provided a three-position screw terminal header 90 locally marked as TB1 that is connected directly to a 120 VAC power supply source. There are additional operating modes included in the new 61-0280 Smart-Dimmer board. A binary two-position DIPswitch 94 is used to select the mode of control, while three separate decimal rotary switches 96, 98, 100 can represent DMX fixture addresses or output light level intensities depending on the mode of control selected by the end-user. Smart-Dimmer 61-0280 control description is as follows:

Control:

Selectable 4 different Modes of Control, 2-position DIPswitch setting for Mode selection

| Dipswitch setting (binary) | Mode |
|---|---|
| 00 | Manual Dim |
| 01 | Full ON |
| 10 | DMX |
| 11 | RDM |

3 digits, 10 positions Rotary (coded) DIP switch sets DMX address or Manual level setting, depending on Mode setting (may be set with power on or off):

| Mode: | |
|---|---|
| Manual Dim | Rotary DIPswitch sets intensity level (000-100 percent). |
| Mode: Full ON | Rotary DIPswitch setting is ignored. |
| Mode: DMX | Rotary DIPswitch sets address (DMX channel 001-512). |
| Mode: RDM | Rotary DIPswitch setting is ignored. |

If address is programmed in RDM mode, then unit switched to another mode (DMX or Manual), and/or disconnected from power, then switched back to RDM mode, the unit should remember and return to its previously programmed RDM address.

Altman also offers the 61-0310 RDM Smart-HID printed circuit boards (not shown) with an on-board relay to remotely turn on or off a metal halide lamp or CFL lamp using the Altman Smart-Track Lighting System. The 61-0310 consists of two sets of boards stacked one on top of the other. The bottom board is the processor board and the top board is the power relay board. An additional feature of the 61-0310 RDM Smart-HID boards is the provision for outputting a 0-10V signal to work with dimming ballasts. It is UL listed for use in a variety of Altman UL listed luminaires and can be used on the Altman Smart-Track System, or as a standalone in a portable or surface mount configuration. The boards each measure approximately 1.0"×4.0" and were designed by Doug Fleenor Designs, Inc. located in Arroyo Grande, Calif.

The latest version of the 61-0310 RDM Smart-HID boards (not shown) are two double-sided printed circuit boards each with two mounting hole locations and a notch cutout for cable passage. There is a single four-position screw terminal block TB3 marked as D+, D−, and COM serving as the RDM IN and RDM OUT to the board and ANA (Analog) for the 10V ballast dimming signal. The RDM input control signal going into TB3 is subsequently converted within the 61-0310 RDM Smart-HID boards and sends a high voltage output to a separate two-position screw terminal blocks TB1 and TB2, locally marked as LOAD and NEUT. The HID ballast power leads are connected directly to screw terminal blocks TB1 and TB2 as well.

On the 61-0310 RDM Smart-HID board, there is also provided a two-position screw terminal header locally marked as TB5 that can be connected to an external solid state relay. There are additional operating modes included in the new 61-0310 Smart-HID board. A binary two-position DIPswitch is used to select the mode of control, while three separate decimal rotary switches can represent DMX fixture addresses or output light level intensities depending on the mode of control selected by the end-user.

Smart-HID 61-0310 control description is as follows:

Control:

There are four different selectable modes of control. Switches are located under the moveable access door on the side of the electronics box.

The single RED (S1) 2-position binary DIP switch sets each mode of control.

The three WHITE (S2, S3, S4) 10-position rotary decimal switches set the DMX address or dimmer levels.

2-position DIPswitch setting for Mode selection:

| Dipswitch setting (binary) | Mode |
|---|---|
| 00 | Manual Dim. Intensity levels 50% to 100% |
| 01 | Full ON. Rotary switch settings are ignored. |
| 10 | DMX. DMX channels 001 to 512. |
| 11 | RDM. Rotary switch settings are ignored. |

(Note:
Fixture will remember the last fixture address setting state after power is removed and re-applied.)

SMART-HID RELAY AND DIMMING CONTROL (IF PROVIDED).

A 0-10V digital output signal to control dimming ballasts down to 50% intensity.

| DMX Console Level | Function | 0-10 V Signal | Intensity Level |
|---|---|---|---|
| 0 | Relay OFF | 0 V | 50% |
| 1 | Relay ON | 1 V | 55% |
| 2 | Relay ON | 2 V | 60% |
| 3 | Relay ON | 3 V | 65% |
| 4 | Relay ON | 4 V | 70% |
| 5 | Relay ON | 5 V | 75% |
| 6 | Relay ON | 6 V | 80% |
| 7 | Relay ON | 7 V | 85% |
| 8 | Relay ON | 8 V | 90% |
| 9 | Relay ON | 9 V | 95% |
| 10 | Relay ON | 10 V | 100% |

If address is programmed in RDM mode, and the unit is switched to another mode (DMX or Manual) and/or disconnected from power, and then switched back to RDM mode, the unit should remember and return to its previously programmed RDM address.

Figure 17:
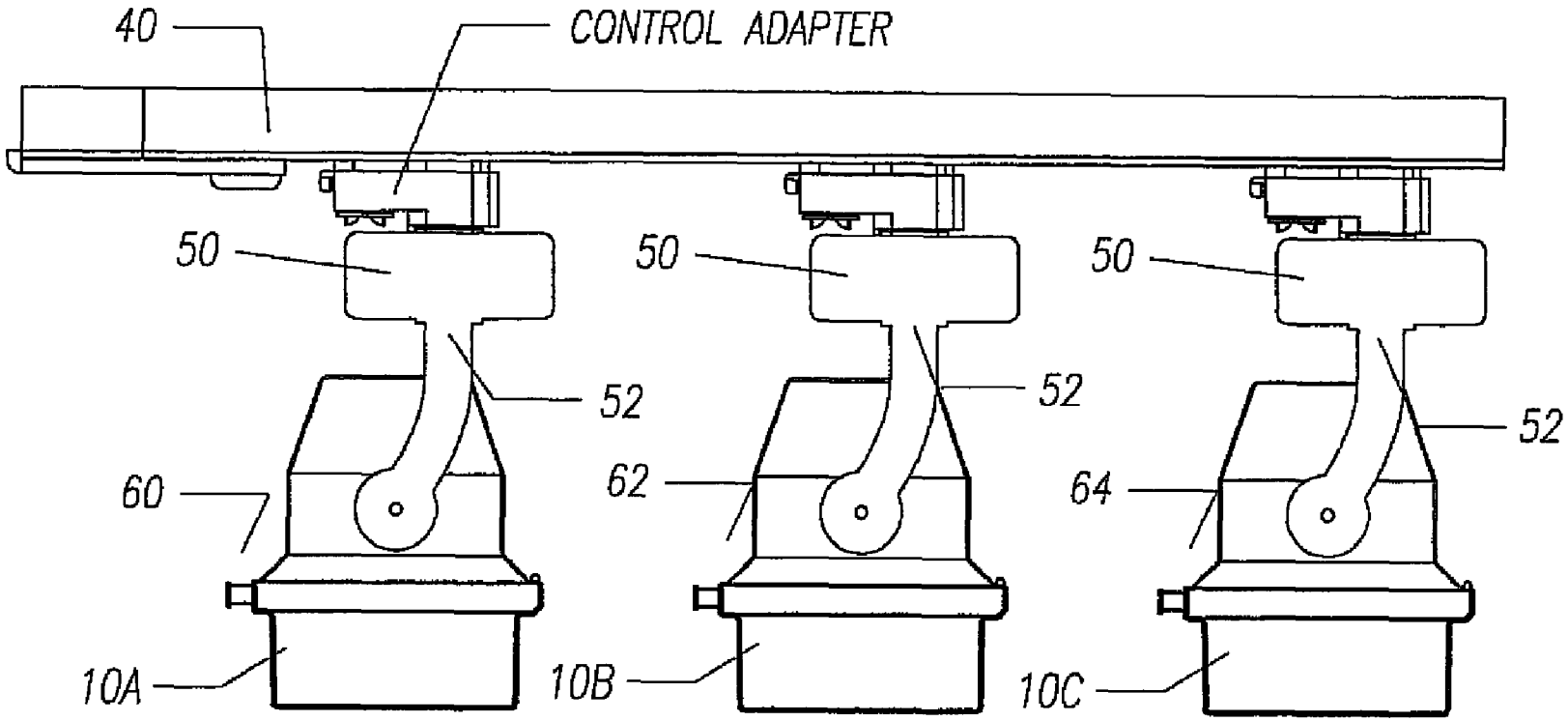

FIG. 17 is a side elevational view of a plurality of luminaires mounted on a track lighting system in accordance with the invention, in which at least one of the luminaires is an LED luminaire, another is an incandescent or quartz halogen luminaire with a Smart-Dimmer installed, and the other may comprise luminaires such as HID, or fluorescent and the like.

Luminaire 60 is a typical incandescent or quartz halogen lamp fixture. Luminaire 62 is a typical HID or CFL fixture and luminaire 64 is a typical low voltage LED fixture. Luminaire 60 is a standard quartz or incandescent lamp luminaire. The 61-0280 RDM Smart-Dimmer board is located in auxiliary housing 50. The auxiliary housing 50 is secured to yoke 52 or secured in any other known way to housing 10A. Likewise for HID or CFL luminaire 62, the ballast is also located in auxiliary housing 50 as well as the 61-0310 RDM Smart-HID board and dimmer controller (not shown). The auxiliary housing 50 is secured to yoke 52 or secured in any other known way to housing 10B. For the LED luminaire 64, the CPDA board 26 or 61-0250 RDM to CK control board 26A, and the LED power supply 36 are removed from the luminaire housing, such as the housing 10C, and are then placed into an auxiliary housing 50. The auxiliary housing 50 may be secured to the yoke 52 or secured in any other known way to the housing 10C.

Figure 18:
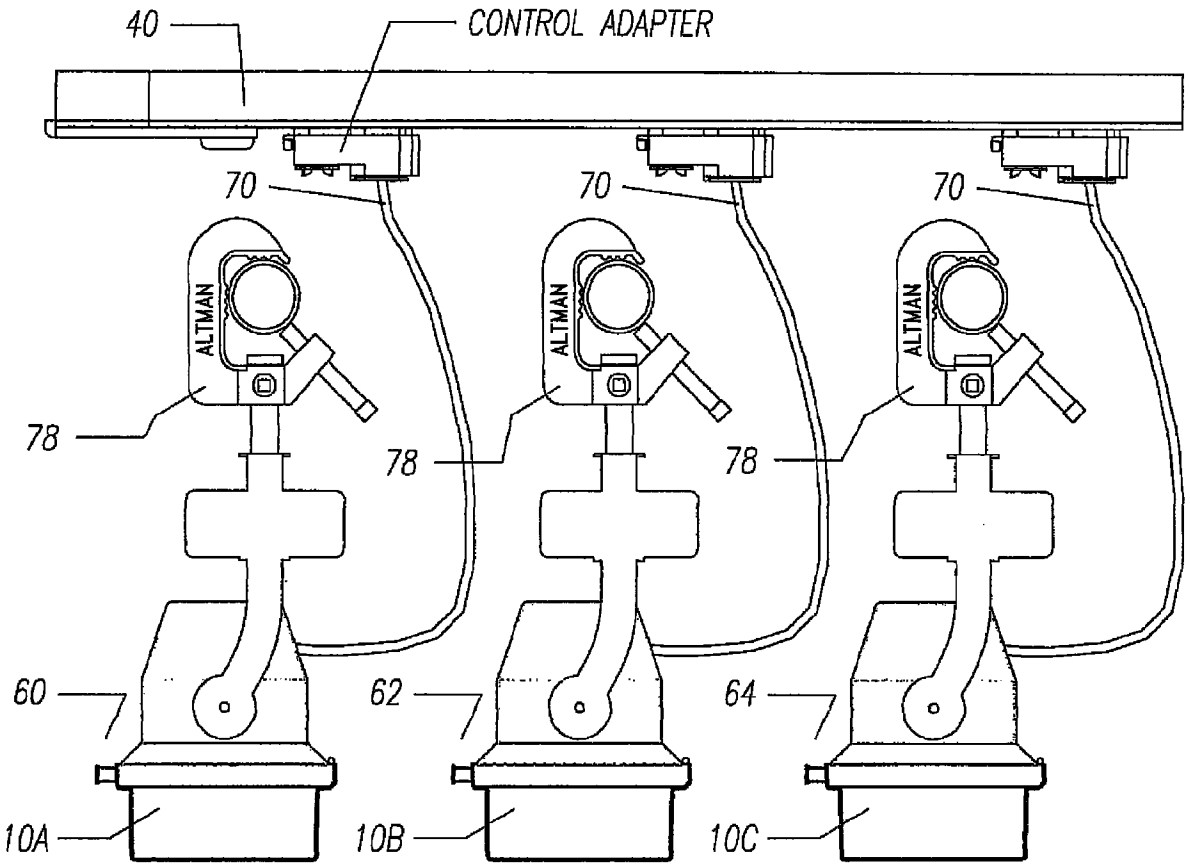
FIG. 18 is a front cross-sectional view of the luminaire bodies physically supported by means of hooks mounted on tubes or pipes, and electrically connected to the track by means of a short length of conductor or pigtail.

FIG. 18 is a front cross-sectional view of the luminaire bodies physically supported by means of hooks mounted on tubes or pipes, and is electrically connected to the track by means of a short length of conductor or pigtail. Each luminaire 60, 62, 64 is attached to a separate or the same pipe by way of a mounting clamp. Power and data to luminaire 60, 62, or 64 shown is supplied by pigtail 70 attached to control track adapter installed into lighting track 40 or T. For more power, other lighting tracks 40 can be installed in close proximity to the lighting track 40 shown.

Figure 19:
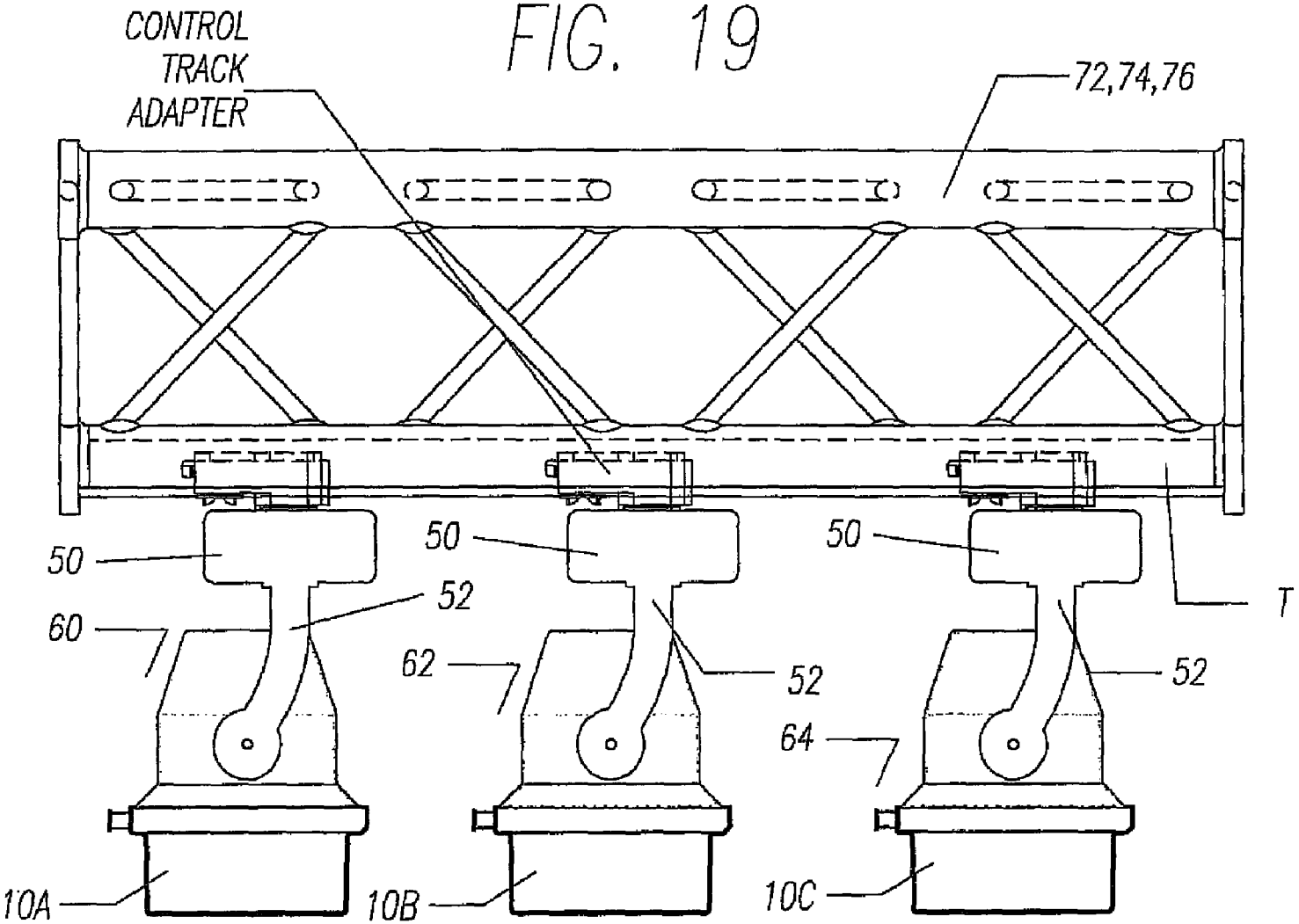

FIG. 19 is a side elevational view of a plurality of luminaires mounted on an integrated truss and track lighting system in accordance with the invention, in which at least one of the luminaires is an LED luminaire, another is an incandescent or quartz halogen luminaire with a Smart-Dimmer installed, and the other may comprise luminaires such as HID, or fluorescent and the like. For LED luminaire 64, the CPDA board 26 or 61-0250 RDM to CK control board 26A, and the LED power supply 36 are removed from the luminaire housing, such as the housing 10C, and are then placed into an auxiliary housing 50. The auxiliary housing 50 may be secured to the yoke 52 or secured in any other known way to the housing 10C. Likewise for HID or CFL luminaire 62, the ballast is also located in auxiliary housing 50. The auxiliary housing 50 is secured to yoke 52 or secured in any other known way to housing 10B. Luminaire 60 is a standard quartz or incandescent lamp luminaire devoid of an auxiliary housing 50.

Figure 20:
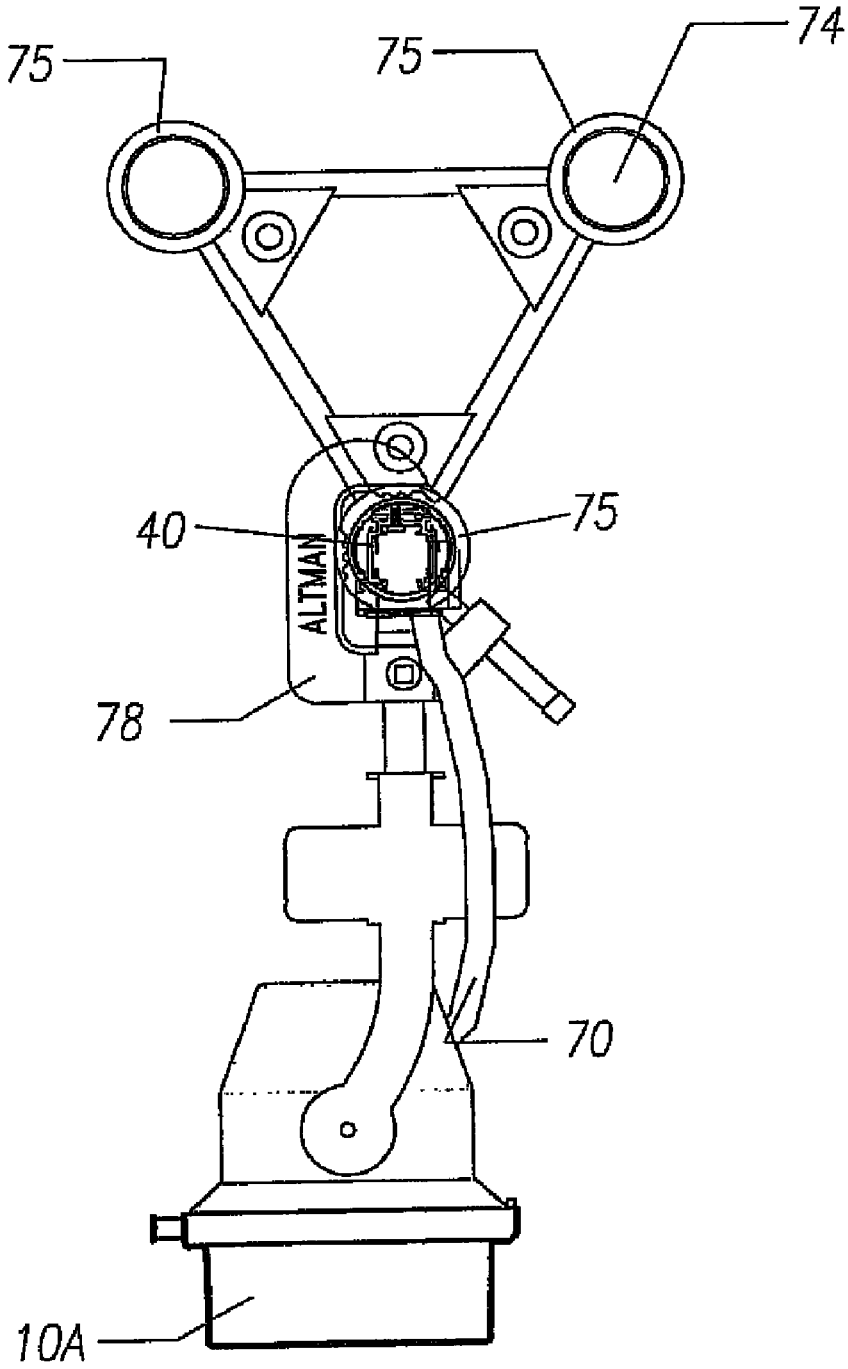
FIG. 20 is a front cross-sectional view of the luminaire body physically supported by means of a hook or clamp mounted onto a truss section and is electrically connected to the track by means of a short length of conductor or pigtail.

FIG. 20 is a front cross-sectional view of the luminaire body physically supported by means of a hook or clamp mounted onto a truss section and is electrically connected to the track by means of a short length of conductor or pigtail. HID or CFL luminaire 62 or LED luminaire 64 is shown attached to support clamp 78. Support clamp 78 is then mounted onto main tube structure 75 of triangle truss 74.

Now similar to FIG. 9, power and data to luminaire 62 or 64 shown is supplied by pigtail 70 attached to control track adapter installed into lighting track 40 fitted into main tube structure 75 of triangle truss 74. For more power, other lighting tracks 40 can be installed in the other two main tube structures 75 of truss 74, up to the maximum power allowed by three lighting tracks on a 3-circuit power input connection.

The combination of power and data on the same track fitting offers the end-user various advantages. The main advantage is LED color-changing track-mounted luminaries 60 can now be used with conventional track-mounted luminaries 62, 64 that use high-voltage incandescent, halogen, compact fluorescent, and HID type lamps (FIGS. 7, 9 and FIGS. 13, 14), all operating on the same line voltage lighting track. The scalable GLOBAL Control power and data system provides ease of use and operating flexibility. With the use of three-circuit track, color-changing LED luminaires like the Altman IQ Spectra Series luminaires can be used on one circuit; incandescent or halogen lamp based luminaires can be used on a second circuit; and compact fluorescent or HID lamp based luminaires can be used on a third circuit. Dimming of the LED luminaires are achieved through the DMX or RDM control signal, as will be well know to those skilled in the art; dimming of incandescent or halogen lamp based luminaires are achieved by standard SCR or other types of wall dimmers; and dimming of compact fluorescent or HID lamp based luminaires can be achieved with the use of DMX and RDM controlled mechanical dimmers. Individual dimming of incandescent or halogen lamp based luminaires based on the preferred embodiment of the present invention is achieved by using the Altman Smart-Dimmer fitted luminaires.

Figure 10:
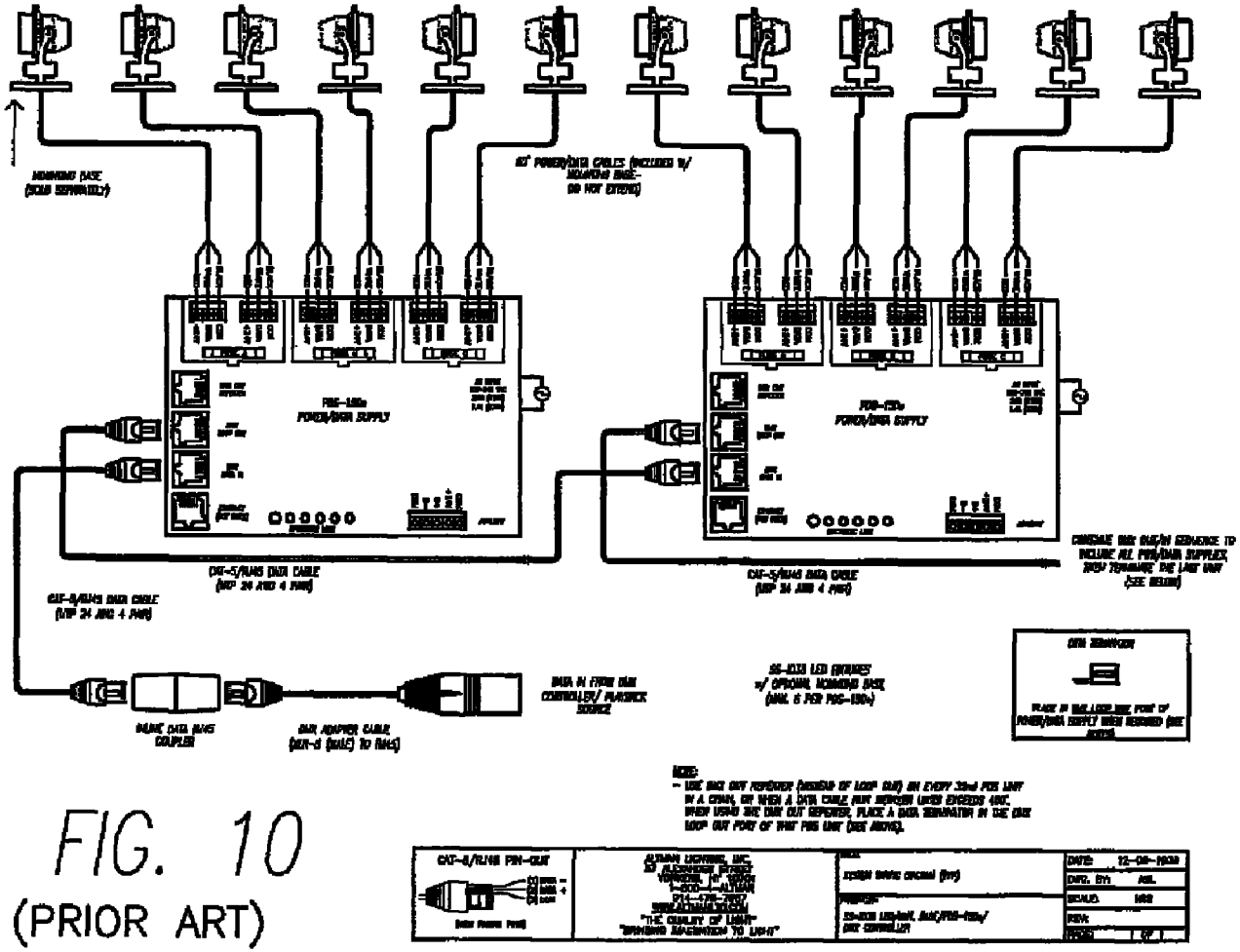
FIG. 10 (PRIOR ART)
FIG. 10 is a schematic diagram of a prior art arrangement in which the individual luminaires are connected to the power and data boards by means of generally long individual conductors.

Other RDM controllable modules like gel-medium color changers, gobo rotators, conventional DMX controlled intelligent moving light luminaires, etc., can now all be used simultaneously on the same GLOBAL Control power and data control track light fitting or EUTRAC Intelligent System without the need to run additional cables and wires that can become unsightly and cumbersome to install and dress as shown in FIG. 10. FIG. 10 shows a typical wiring diagram and layout for a similar Color Kinetics Color Burst 6 system devoid of a lighting track. Overall system cost and installation time is reduced using this system.

Altman Lighting presently owns two U.S. patents relating to a DMX or similarly controlled Digital Micromirror Device (DMD) or Digital Light Projector (DLP) moving luminaire—U.S. Pat. No. 6,671,005, "Digital micromirror stage lighting system," and U.S. Pat. No. 6,412,972, "Digital light protection apparatus with digital micromirror device and rotatable housing." This computer-controlled DMD/DLP moving luminaire can be used in the Nordic Aluminium GLOBAL Control Track taking AC power from the track and digital control communications data from the track as well. A separate video and/or audio signal interface, i.e., X10 video sender and receiver or similar modules can be used to provide video and/or audio signals from a remote source directly to the DMD/DLP moving luminaire by way of RF or IR carrier means.

Altman Lighting is the assignee of pending patent application Ser. No. 12/652,530 filed on Jan. 5, 2010 entitled, "LED White Light Luminaire with Imaging Capability". This application is incorporated as if fully set forth herein. The computer-controlled LED/LCD imaging luminaire discussed in this application can be used in the Nordic Aluminium GLOBAL Control Track taking AC power from the track and digital control communications data from the track as well. A separate video and/or audio signal interface, i.e., X10 video sender and receiver or similar modules can be used to provide video and/or audio signals from a remote source directly to the LED/LCD moving luminaire by way of RF or IR carrier means.

RDM control signals are provided by RDM control boards, Personal Data Assistant's (PDAs), or other RDM controllers. With the advancement in wireless control technology, RDM signals can now be transmitted either by IR (infrared) or RF (radio-frequency) conversion devices from a transmitter to a receiver without having to deal with cumbersome cables or wiring. City Theatrical Inc., located in the Bronx, N.Y., offers a DMX-512 WDS Wireless Dimming System, and Goddard Design Company located in Brooklyn, N.Y., offers a DMX-WOW (WithOut Wires) system. Both companies, among many others, offer wireless transmission of RDM control signal products that can easily be incorporated into the present LED color-changing luminaire and track lighting system invention. The use of Bluetooth or Zigbee WiFi protocols is another option for wireless data control.

An alternate track lighting system embodiment and hanging configuration can be used for applications where standard lighting track and adapters manufactured by Halo, Juno, Lightolier, etc., can be used to power the IQ Spectra Series luminaires with a separate RDM or other digital serial communication control signal pigtail or receptacle exiting from the luminaire housing. Returning to FIGS. 9 and 14, in applications where Unistrut metal framing is used, a heavy weighted luminaire can be installed in the Unistrut metal framing. The RDM or other digital serial communication can be obtained from a convenience adapter that extracts the DMX control data signal off the GLOBAL Control Track "T" to a pigtail 70 or receptacle mounted on a breakout box secured to the Nordic Aluminium GLOBAL Control Track adapter.

The power and data track can be designed to us robust conductors for both power and data, and further include a unistrut type system that can handle heavier weight loads much more than the present Nordic Aluminium and Selux Eutrac designs can accommodate. Such a system would comprise a Smart-Strut Power and Data Track Lighting System.

In the alternate wireless track lighting system embodiment, the IQ Spectra Series track-mounted LED luminaires will have both the CPDA or 61-0250 and the LED power supply installed in the IQ luminaire housing as before, but the RDM or other data control signal lines serving as inputs to the CPDA or 61-0250 will now be brought out externally by way of a receptacle or pigtail to a remote RDM receiver. This remote RDM receiver will receive an RDM signal from an RDM console or other transmitter and then forward the digital control signal to each IQ Spectra Series Luminaire. This flexibility allows a customer to use the existing track, but still offer the color-changing capability and overall look of the Altman IQ Spectra Series luminaires, and can be used with other class of luminaires in their present layout.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What we claim:

1. A track lighting system comprising:

an elongate track suitable for attachment to a support surface, said track including a plurality of longitudinal guideways and means for supporting a plurality of DMX and RDM compatible components selected from a group consisting of LED, incandescent, quartz halogen, compact fluorescent (CFL), high intensity discharge (HID) and ultra-violet (UV) luminaires;

a plurality of current conductors arranged in at least some of said longitudinal guideways, at least a first number of conductors being power conductors and a second number of conductors being data conductors, said conductors being electrically isolated from each other;

adapter means connected to a source of power for applying electrical power to said power conductors and connected to a source of control data for applying data signals to said data conductors;

at least one RDM component being an LED color changing luminaire including a plurality of LEDs, each generating one of a discrete plurality of colors when energized; and data converter means for converting data on said data lines to control signals for each individual group of color LEDs to create a desired composite color; and a housing between said adaptor means and a compatible component for housing at least said data converter means.

2. The track lighting system as defined in claim 1, wherein said data converter means includes means for accepting both DMX and RDM control signals.

3. The track lighting system as defined in claim 2, wherein said data converter means includes means for providing a DMX output signals suitable for connection to an LED light engine.

4. The track lighting system as defined in claim 1, wherein said data converter means includes programming means for selectively programming one of four control modes for controlling the mode of operation of a compatible component to one mode of operation selected from the group including manual control, full output control, DMX and RDM control.

5. The track lighting system as defined in claim 4, wherein said programming means includes a combination of binary two positions DIP switches and decimal rotary switches.

6. The track lighting system as defined in claim 1, wherein said data converter means includes means for accepting serial data in accordance with a communication protocol selected from a group including DMX-512, Ethernet, Strand AMX, RS 232, RS 485, DALI, RDM and Zigbee wireless protocols.

7. An LED luminaire track lighting system comprising:

a support truss including means for supporting the truss from a support surface;

an elongate track mounted with said support truss, said track including a plurality of longitudinal guideways;

support means for supporting a plurality of DMX and RDM compatible components on said support truss;

a plurality of current conductors arranged in at least some of said longitudinal guideways, at least a first number of conductors being power conductors and a second number of conductors being data conductors, said conductors being electrically isolated from each other;

adapter means connected to a source of power for applying electrical power to said power conductors and connected to a source of control data for applying data signals to said data conductors;

at least one component being an LED color changing luminaire including a plurality of LEDs, each generating one of a discrete plurality of colors when energized; and data converter means for converting data on said data lines to control signals for each individual group of color LEDs to create a desired composite color.

8. The track lighting system as defined in claim 7, wherein said support means attaches said components directly to the support truss, electrical power and data control signals being supplied to said components by said connecting means from said conductors on said track.

9. The track lighting system as defined in claim 7, wherein said support truss includes at least one structural hollow tube dimensioned and configured to at least partially receive an elongate track to integrate power and data into said at least one hollow tube, whereby said at least one hollow tube supports both said track and at least one component supplied data signals and power by said track.

10. The track lighting system as defined in claim 7, wherein said support truss is in the form of a single ladder truss formed by two spaced hollow tubes for at least partially receiving a 3-circuit mains track 3×16-amperes in each hollow tube for a total of 3×16 A×2.

11. The track lighting system as defined in claim 7, wherein said support truss is in the form of a triple "Triangle" truss formed of three spaced hollow tubes for at least partially receiving a 3-circuit means track 3×16-amperes in each hollow tube for a total of 3×16 A×3.

12. The track lighting system as defined in claim 7, wherein said support truss is in the form of a quad "box truss" formed of four spaced hollow tubes for at least partially receiving a 3-circuit means track 3×16-amperes in each hollow tube for a total of 3×16 A×4.

13. The track lighting system as defined in claim 7, wherein said data converter means comprises a smart dimmer.

14. A track lighting system comprising:

an elongate track including means for attachment to a support surface, said track including a plurality of longitudinal guideways and means for supporting a plurality of DMX and RDM compatible components;

a plurality of current conductors arranged in at least some of said longitudinal guideways, at least a first number of conductors being power conductors and a second number of conductors being data conductors, said conductors being electrically isolated from each other;

adapter means connected to a source of power for applying electrical power to said power conductors and connected to a source of control data for applying data signals to said data conductors;

at least one component being an LED color changing luminaire including a plurality of LEDs, each generating one of a discrete plurality of colors when energized;

data converter means for converting data on said data lines to control signals for each individual component, said data converter means including programming means for selectively programming one of four control modes for controlling the mode of operation of a compatible component to one mode of operation selected from the group including manual control, full output control, DMX and RDM control.

15. The track lighting system as defined in claim 14, wherein said programming means includes a combination of binary two positions DIP switches and decimal rotary switches.

* * * * *